US007900772B2

(12) United States Patent
Sack et al.

(10) Patent No.: US 7,900,772 B2
(45) Date of Patent: Mar. 8, 2011

(54) CHILD-RESISTANT, SENIOR-FRIENDLY UNIT DOSE CONTAINER

(75) Inventors: Ryen Sack, Loves Park, IL (US); Curtis A. Knutson, Loves Park, IL (US); Thomas Moyer, Freeport, IL (US); Tyler Theis, St. Johns, MI (US); Richard M. Bowen, Jr., Auburn, AL (US); John T. Peterson, Rockford, IL (US)

(73) Assignee: Anderson Packaging, Inc., Rockford, IL (US)

( * ) Notice: Subject to any disclaimer, the term of this patent is extended or adjusted under 35 U.S.C. 154(b) by 0 days.

(21) Appl. No.: 12/577,228

(22) Filed: Oct. 12, 2009

(65) Prior Publication Data

US 2010/0300923 A1 Dec. 2, 2010

Related U.S. Application Data

(60) Provisional application No. 61/182,812, filed on Jun. 1, 2009.

(51) Int. Cl.
*B65D 50/14* (2006.01)

(52) U.S. Cl. ..... 206/528; 206/531; 206/538; 206/1.5

(58) Field of Classification Search ..... 206/530–534, 206/538–539, 1.5, 320, 449, 535–537, 528; 229/125.125

See application file for complete search history.

(56) References Cited

U.S. PATENT DOCUMENTS

| | | | | |
|---|---|---|---|---|
| 3,888,350 | A | 6/1975 | Horvath | |
| 3,987,891 | A | 10/1976 | Horvath | |
| 4,192,422 | A | 3/1980 | Kotyuk | |
| 4,401,210 | A | 8/1983 | Anjou | |
| 4,998,623 | A * | 3/1991 | Doull | 206/531 |

(Continued)

FOREIGN PATENT DOCUMENTS

WO 01/15998 A1 3/2001

(Continued)

OTHER PUBLICATIONS

PCT International Search Report &Written Opinion of the International Searching Authority issued for corresponding International Application No. PCT/US2010/036532, mailed Aug. 2, 2010.

*Primary Examiner* — J. Gregory Pickett
*Assistant Examiner* — Robert Poon
(74) *Attorney, Agent, or Firm* — Howson & Howson LLP

(57) ABSTRACT

A child-resistant and senior-friendly package comprising one or more blister cards housed within a hollow molded plastic sleeve is provided. The sleeve is assembled from a pair of identical molded plastic body sections. Each body section has a latch and an unlocking tab and the blister card has a latch-catcher for cooperating with the latch to automatically lock the blister card in a storage position within the sleeve. The sleeve has a pair of opposite spaced-apart tabs in the side edges thereof that must be simultaneously pressed to unlatch the latches from the latch-catchers to permit the blister card to be slid from the storage position to a dispensing position. When pressed, the tabs flex the blister card off adjacent latches. An embodiment including a pair of separate blister cards is provided in which the blister cards are dispensed through opposite dispensing ends of the sleeve.

22 Claims, 15 Drawing Sheets

U.S. PATENT DOCUMENTS

| | | | | |
|---|---|---|---|---|
| 5,125,505 | A * | 6/1992 | Kurosaki | 206/39.4 |
| 5,740,938 | A | 4/1998 | Hofmann et al. | |
| 5,878,887 | A * | 3/1999 | Parker et al. | 206/528 |
| 6,021,901 | A | 2/2000 | Wolfe | |
| 6,036,018 | A | 3/2000 | Harrold | |
| 6,460,693 | B1 | 10/2002 | Harrold | |
| 6,789,677 | B2 | 9/2004 | Maietta | |
| 6,832,686 | B2 | 12/2004 | Donegan | |
| 7,581,642 | B2 | 9/2009 | Knutson et al. | |
| 2004/0108322 | A1 * | 6/2004 | Maietta et al. | 221/2 |
| 2004/0262189 | A1 * | 12/2004 | Fraser et al. | 206/536 |
| 2005/0183981 | A1 * | 8/2005 | Gelardi | 206/531 |
| 2007/0023317 | A1 * | 2/2007 | Brozell et al. | 206/538 |
| 2007/0102318 | A1 | 5/2007 | Gelardi et al. | |
| 2008/0251410 | A1 | 10/2008 | Gelardi | |
| 2008/0290109 | A1 | 11/2008 | Williams | |
| 2009/0045078 | A1 * | 2/2009 | Gelardi et al. | 206/1.5 |
| 2009/0045096 | A1 * | 2/2009 | Knutson et al. | 206/570 |
| 2009/0071864 | A1 | 3/2009 | Costa et al. | |
| 2009/0095649 | A1 | 4/2009 | Costa | |
| 2009/0178948 | A1 | 7/2009 | Reilley et al. | |
| 2009/0184022 | A1 * | 7/2009 | Coe et al. | 206/531 |
| 2009/0230013 | A1 * | 9/2009 | Born et al. | 206/531 |
| 2009/0255842 | A1 * | 10/2009 | Brozell et al. | 206/531 |

FOREIGN PATENT DOCUMENTS

| | | | |
|---|---|---|---|
| WO | 2009/058979 | A1 | 5/2009 |

* cited by examiner

CHILD-RESISTANT, SENIOR-FRIENDLY UNIT DOSE CONTAINER

CROSS-REFERENCE TO RELATED APPLICATION

This application claims the benefit under 35 USC §119(e) of U.S. Provisional Patent Application No. 61/182,812, filed Jun. 1, 2009.

BACKGROUND OF THE INVENTION

The present invention relates to a container, or package, for containing and storing items, such as tablets, doses of medicine, or the like, that can be dispensed therefrom, and more particularly, the present invention relates to a compact package that includes a molded plastic outer sleeve for housing one or more blister cards and that provides child-resistant, senior-friendly dispensing properties.

U.S. Pat. No. 7,581,642 B2 issued to Knutson et al. and U.S. Patent Application Publication Nos. 2009/0045096 A1 of Knutson et al. and 2009/0178948 A1 of Reilley et al. are assigned to Anderson Packaging, Inc., the assignee of the present application, and disclose examples of packages including a molded plastic sleeve and blister card combination that provides child-resistant, senior-friendly dispensing properties. Other examples of packages are disclosed by U.S. Patent Application Publication Nos. 2007/0102318 A1 and 2005/0183981 A1.

Although the packages disclosed by the above referenced patent and published applications are suitable for their intended purposes, there is a need for alternate designs of such packages that are of novel construction and that are difficult for a young child to open (i.e. receive a so-called "F=1" child resistant rating), yet can readily be opened and closed by an intended end-user, such as a senior citizen. Preferably, the package includes a molded plastic container body or sleeve for storing a blister card, tray or the like on which numerous items, such as tablets, doses of medicine, or the like, are individually secured in blister compartments. The blister card should be able to be slid between a retracted position in which the items are protected and housed within the package and a dispensing position in which the blister card at least partially extends in an exposed condition from the package.

BRIEF SUMMARY OF THE INVENTION

According to a first aspect of the present invention, a package including a blister card and a hollow plastic sleeve having child-resistant, senior-friendly dispensing properties is provided for storing and dispensing tablets or like small individual items. The blister card includes a card section having a plurality of blister compartments for holding the tablets or like items, and the sleeve includes an opposed pair of side edges and at least one dispensing end. The sleeve provides a compact protective housing for the blister card when the blister card is in a storage position within the sleeve, and the blister card is retained in a stable manner within the sleeve and is only capable of sliding type-movement relative to the sleeve in an end-to-end direction. This sliding movement is between the storage position and a dispensing position in which a proximal end of the card section extends outside the sleeve to expose some or all of the blister compartments.

According to this embodiment of the present invention, the plastic sleeve is formed from separate first and second opposed molded body sections that are substantially identical. For instance, the first and second body sections can be completely identical having been manufactured from the same mold or from identical molds. The combination of the blister card and sleeve provides a plurality of latches and latch-catchers that cooperate to automatically lock and retain the blister card in the storage position when the blister card is slid within the sleeve to the storage position.

The opposed pair of side edges of the sleeve includes a pair of opposed resiliently-depressible tabs for unlatching the latches from the latch-catchers when the pair of opposed tabs are simultaneously depressed toward one another. One of the pair of opposed resiliently-depressible tabs is formed integral with the first body section and the other of the pair of opposed resiliently-depressible tabs is formed integral with the second body section, and both of the resiliently-depressible tabs must be simultaneously depressed to permit the blister card to slide relative to the sleeve from the storage to a dispensing position. Preferably, but not by way of limitation, the side edges and the pair of opposed depressible tabs are spaced apart by 2 inches (5.1 cm) or more, whereby the pair of opposed depressible tabs are difficult to simultaneously depress by a single small hand of a young child due to the spacing thereby enhancing the child-resistance property of the package.

In one particular contemplated version of the present invention, the above referenced sleeve is adapted to house a single blister card. According to this embodiment, the sleeve includes a pair of latches that extend in opposite directions toward opposite faces of the blister card from an opposed pair of wall panels (i.e., upper and lower) of the sleeve, and when the blister card is in the storage position, the blister card includes a pair of latch-catchers for cooperatively engaging and catching the oppositely-extending latches to automatically lock the blister card in the storage position within the sleeve. Each of the opposed depressible tabs in the side edges of the sleeve has an arm with an oppositely tapered surface extending within the sleeve transverse to a longitudinal axis of the sleeve. Accordingly, when each of the opposed tabs is depressed, each of the oppositely tapered surfaces of the arms engages and flexes the card section of the blister card in an opposite direction such that an adjacent one of the latches is released from an adjacent one of the latch-catchers. Thus, each one of the arms flexes the card section in an opposite direction relative to the opposed arm of the opposed tab since the latches themselves extend in opposite directions toward the card. For instance, one corner of the card section is flexed upwardly out of engagement with a latch extending from below the blister card, and an opposite corner of the card section is flexed downwardly out of engagement with the opposite latch extending from above the blister card.

According to another embodiment of the present invention, the sleeve can house two or more separate blister cards. In this embodiment, the hollow plastic sleeve has an opposed pair of wall panels, an opposed pair of side edges, and an opposed pair of open dispensing ends. One of the blister cards is slidable relative to the sleeve to a dispensing position through one of the opposed pair of dispensing ends of the sleeve and another one of the blister cards is slidable relative to the sleeve to a dispensing position through an opposite one of the opposed pair of dispensing ends of the sleeve.

This multi-blister card package can further include a divider panel positioned between the blister cards within the sleeve. For instance, a pair of blister cards can be disposed back-to-back within the sleeve with the divider panel sandwiched therebetween. The sleeve of this package can include a separate set of latches for each one of the blister cards. Thus, each of the blister cards can include a corresponding set of latch-catchers for cooperatively engaging and catching its corresponding set of latches when the blister card is in a storage position to automatically lock the blister card in the storage position within the sleeve, and the opposed pair of side edges of the sleeve can include separate sets of opposed resiliently-depressible tabs. One set of tabs is used to unlatch said latches from the latch-catchers of one of the blister cards, and the other set of tabs is used to unlatch the latches from the latch-catchers of the other one of the blister cards.

According to yet another aspect of the present invention, a one-piece, molded plastic body section, or half, is provided. The body section can be assembled with a like body section to form a hollow plastic sleeve for housing one or more blister cards having a plurality of blister compartments. The body section can include a major wall panel of slightly greater dimensions in plan as compared to that of the blister card such that the wall panel can cover and shield a front or rear face of the blister card. Sidewalls project from opposite sides of a face of the wall panel, and at least one of said sidewalls includes an integrally-formed, resilient, depressible tab. The body section can also include a pair of spines or support rails projecting from the face of the wall panel a spaced distance from the sidewalls and extending in a direction along the sidewalls. A latch projects from the face of the wall panel adjacent the tab and preferably between one of the sidewalls and one of the support rails. A stop or the like can project from the face of the wall panel at a dispensing end and/or at the end of the sleeve opposite the dispensing end.

According to yet a still further aspect of the present invention, a method of assembling the above referenced package is provided. The method includes molding a plurality of identical plastic body sections and assembling together any two of the body sections to form a hollow sleeve having at least one dispensing end. After assembling the container body or sleeve, the method includes the step of loading at least one blister card into the sleeve by inserting the blister card into the dispensing end and sliding the blister card in an end-to-end direction into the sleeve to a storage position where it automatically becomes locked within the sleeve.

BRIEF DESCRIPTION OF THE DRAWINGS

The present invention should become apparent from the following description when taken in conjunction with the accompanying drawings, in which.

DETAILED DESCRIPTION OF THE INVENTION

Figure 1:
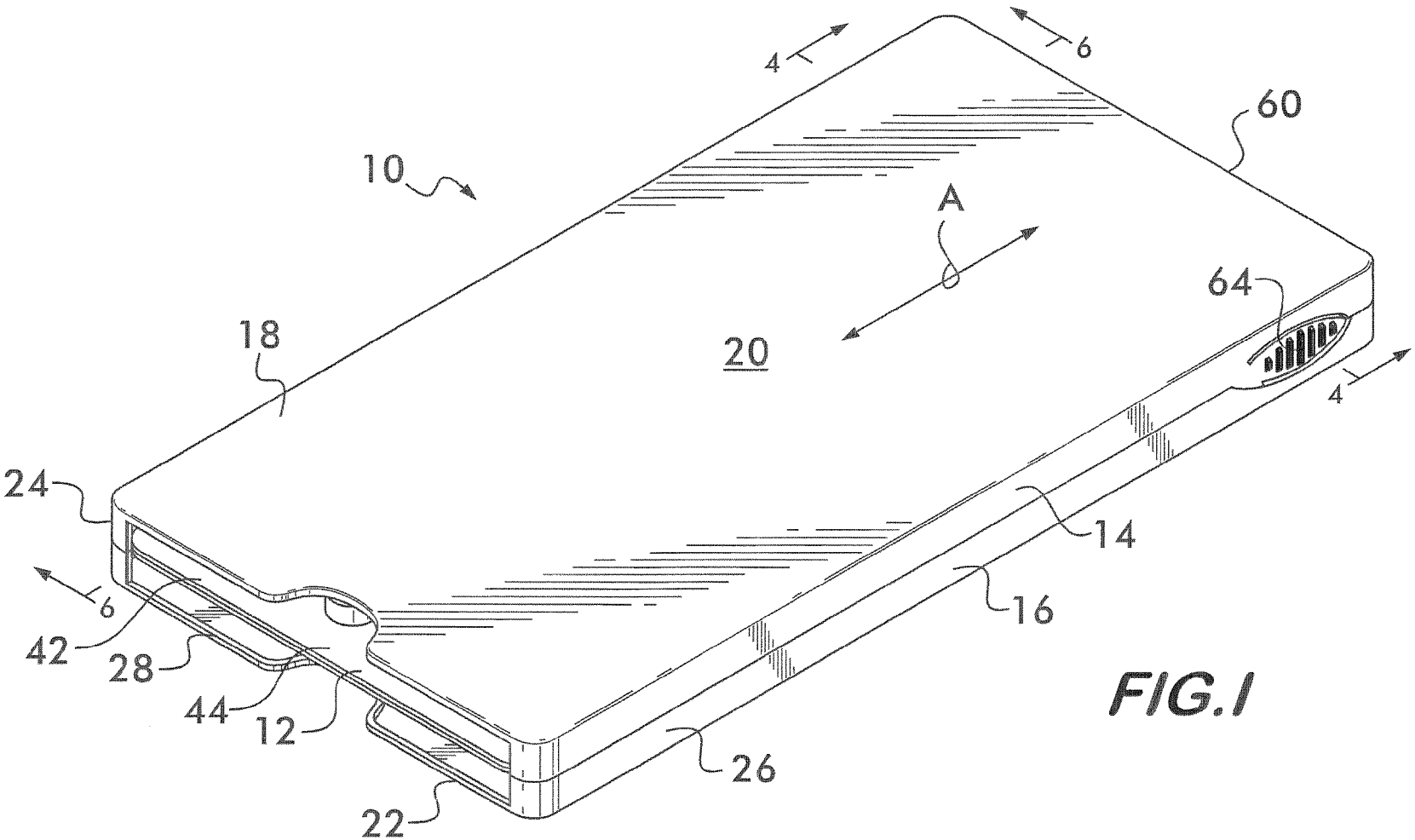
FIG. 1 is perspective view of a first embodiment of a package including a sleeve with a blister card retained in a storage position according to the present invention.

The present invention is directed to the structure of packages comprising one or more separate blister cards contained within a protective plastic sleeve. The present invention is also directed to a one-piece, injection-molded, plastic body section, or half, that can be assembled with a like body section to form a hollow plastic sleeve for housing one or more blister cards. The present invention is further directed to a method of assembling such a package. Various embodiments are disclosed herein and various alterations can be made to the embodiments within the scope of the present invention.

Turning to a first embodiment of such a package, package 10 is illustrated in FIGS. 1-8 and is assembled from a single blister card 12 and a pair of identical body sections, 14 and 16, that when joined together form a hollow sleeve 18 for housing the single blister card 12. As an example, the body sections 14 and 16 can be made of plastic, such as polypropylene or like thermoplastic material, and can be formed, for instance, by injection molding or like plastic molding technique.

The purpose of the sleeve 18 is to form a protective compact case for housing the blister card 12. This particular embodiment of the sleeve 18 includes opposite major wall panels 20 and 22, opposite side edges 24 and 26, and a single dispensing end 28. The blister card 12 is initially loaded into the sleeve 18 via insertion into the dispensing end 28 and by sliding the blister card 12 in an end-to-end direction into the sleeve 18 to a storage position best illustrated in FIGS. 1, 4 and 6. In the storage position, the blister card 12 is held in a substantially stationary position relative to the sleeve 18 and very little movement of the blister card 12 relative to the compact sleeve 18 is permitted. An alternative manner of loading the blister card 12 includes positioning the blister card 12 into one of the body sections, 14 or 16, before the body sections 14 and 16 are secured together.

For reasons explained in greater detail below, the blister card 12 automatically becomes locked in the storage position when it is fully inserted within the sleeve 18, and thereafter, a user is required to perform multiple simultaneous actions to free the blister card 12 from the storage position to enable the blister card 12 to slide relative to the sleeve 18 to a dispensing position. The above referenced multiple simultaneous actions are of a type not readily accomplished by a young child but that can readily be performed by intended users, such as adults.

Figures 2, 8:
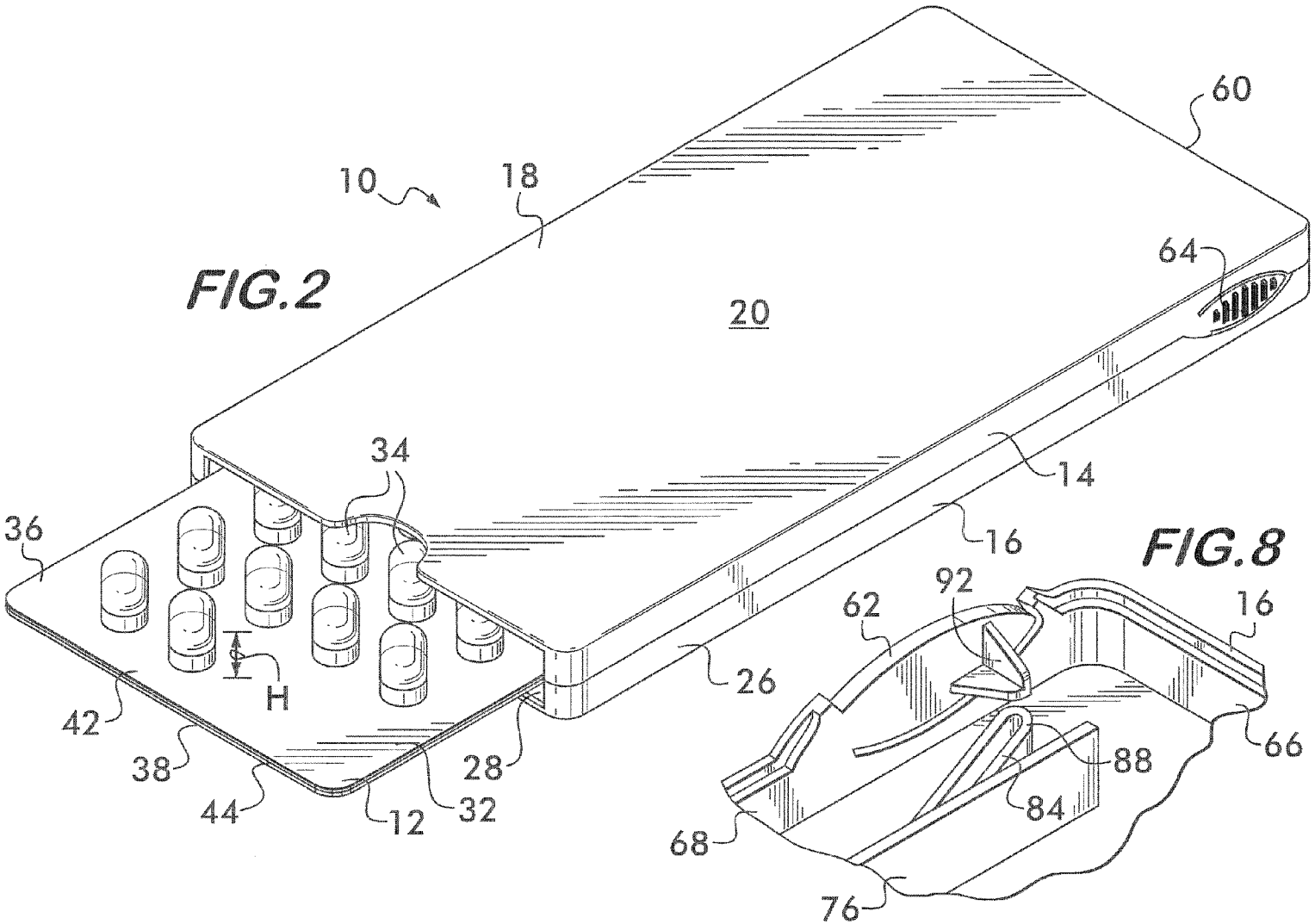
FIG. 2 is a perspective view of the package of FIG. 1 with the blister card partially extended from the sleeve.
FIG. 8 is an enlarged perspective view of a rear corner of one of the body sections of the sleeve of FIG. 1.
Figure 7:
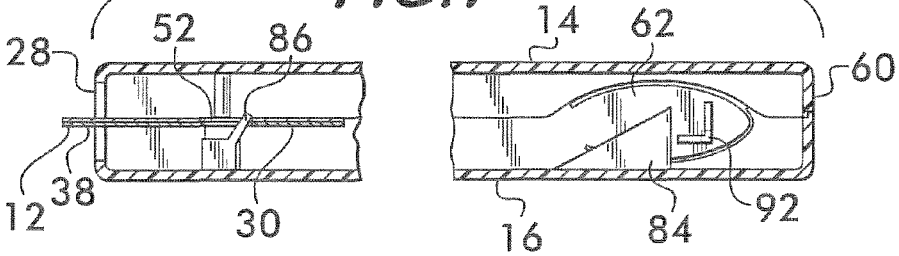
FIG. 7 is a cross-sectional view of the package of FIG. 1 similar to the cross-sectional view of FIG. 6 except that FIG. 7 shows the blister card in a dispensing position fully extended from the sleeve.
Figure 9:
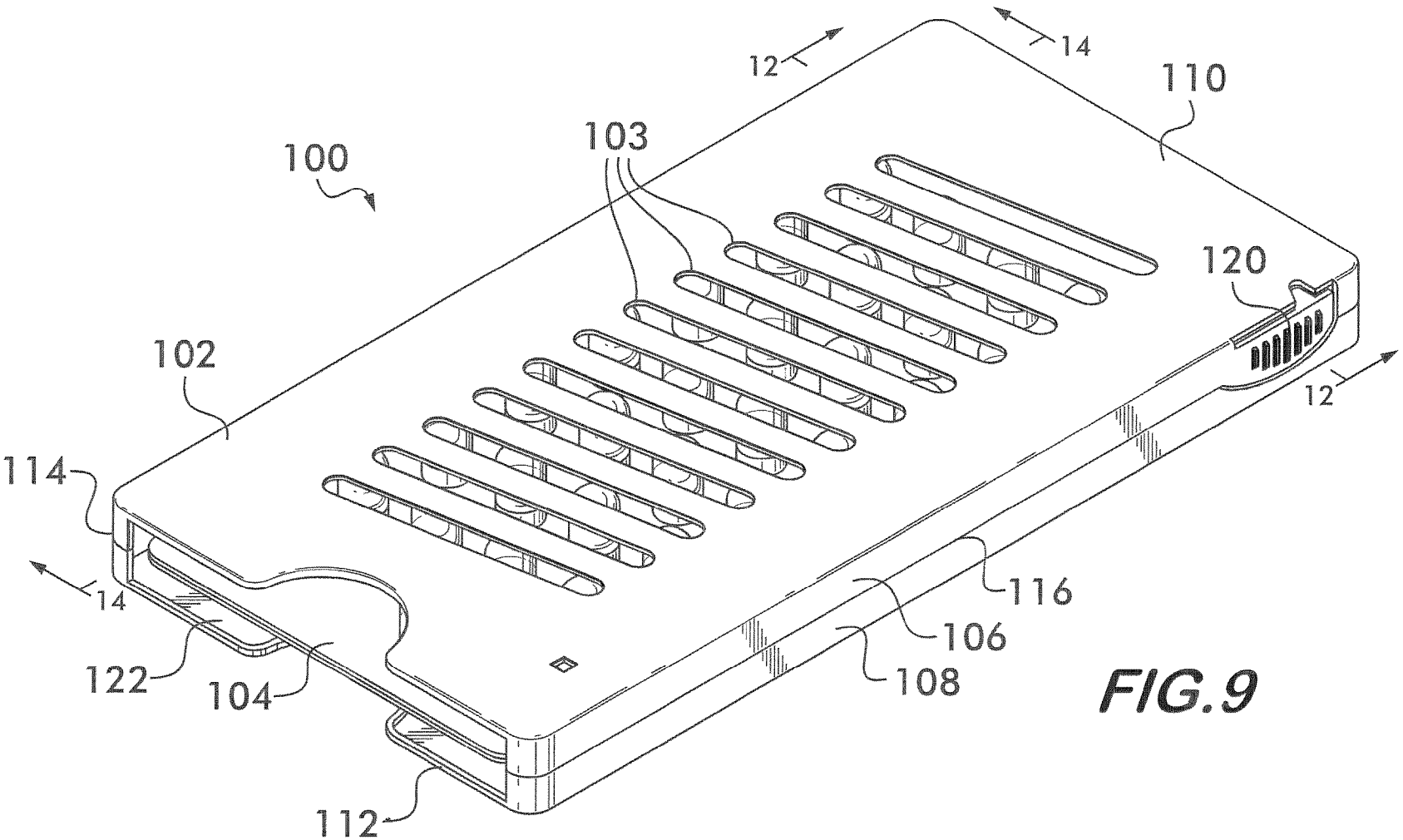
FIG. 9 is perspective view of a second embodiment of a package including a sleeve with a blister card retained in a storage position according to the present invention.
Figure 10:
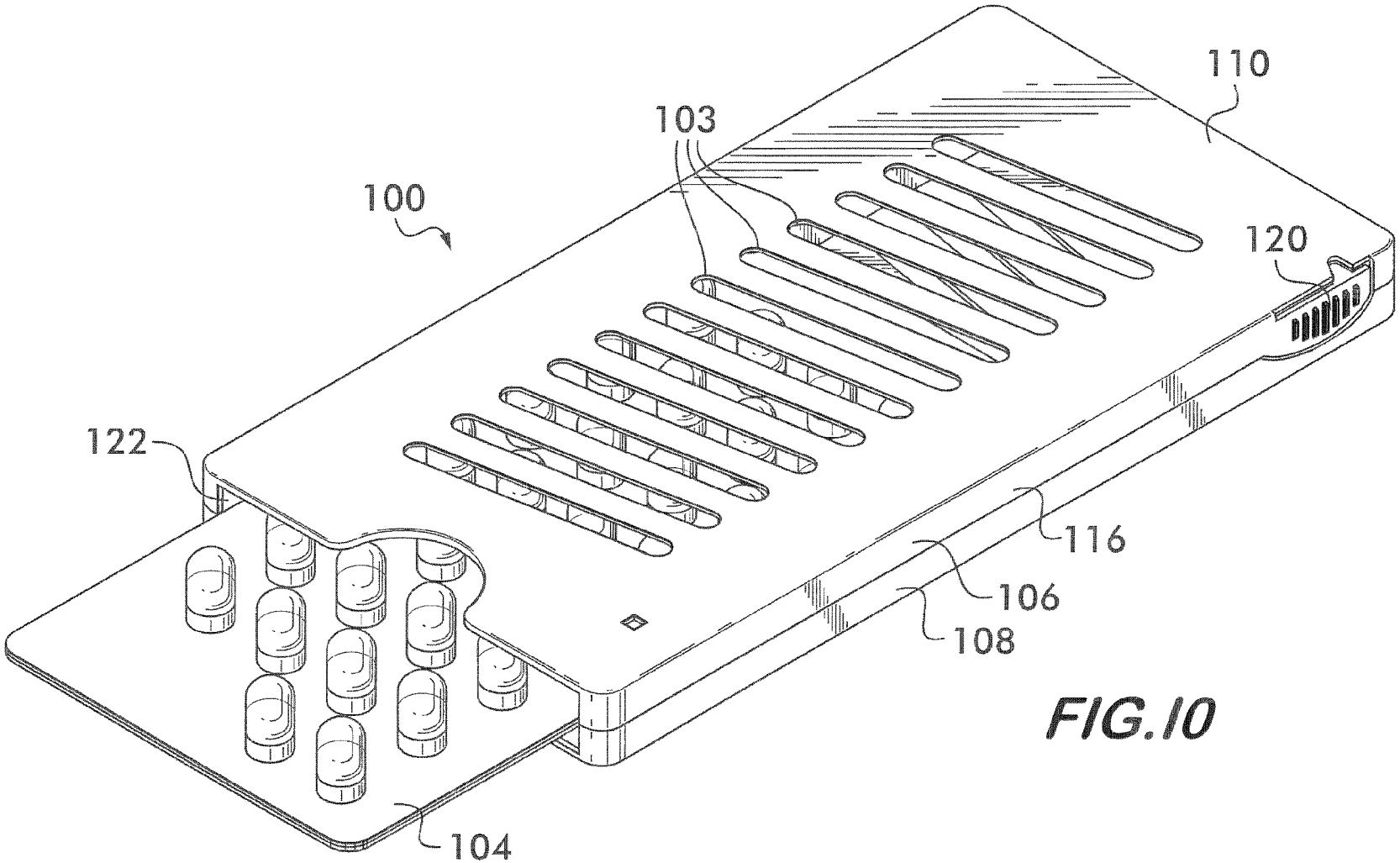
FIG. 10 is a perspective view of the package of FIG. 9 with the blister card partially extended from the sleeve.
Figure 11:
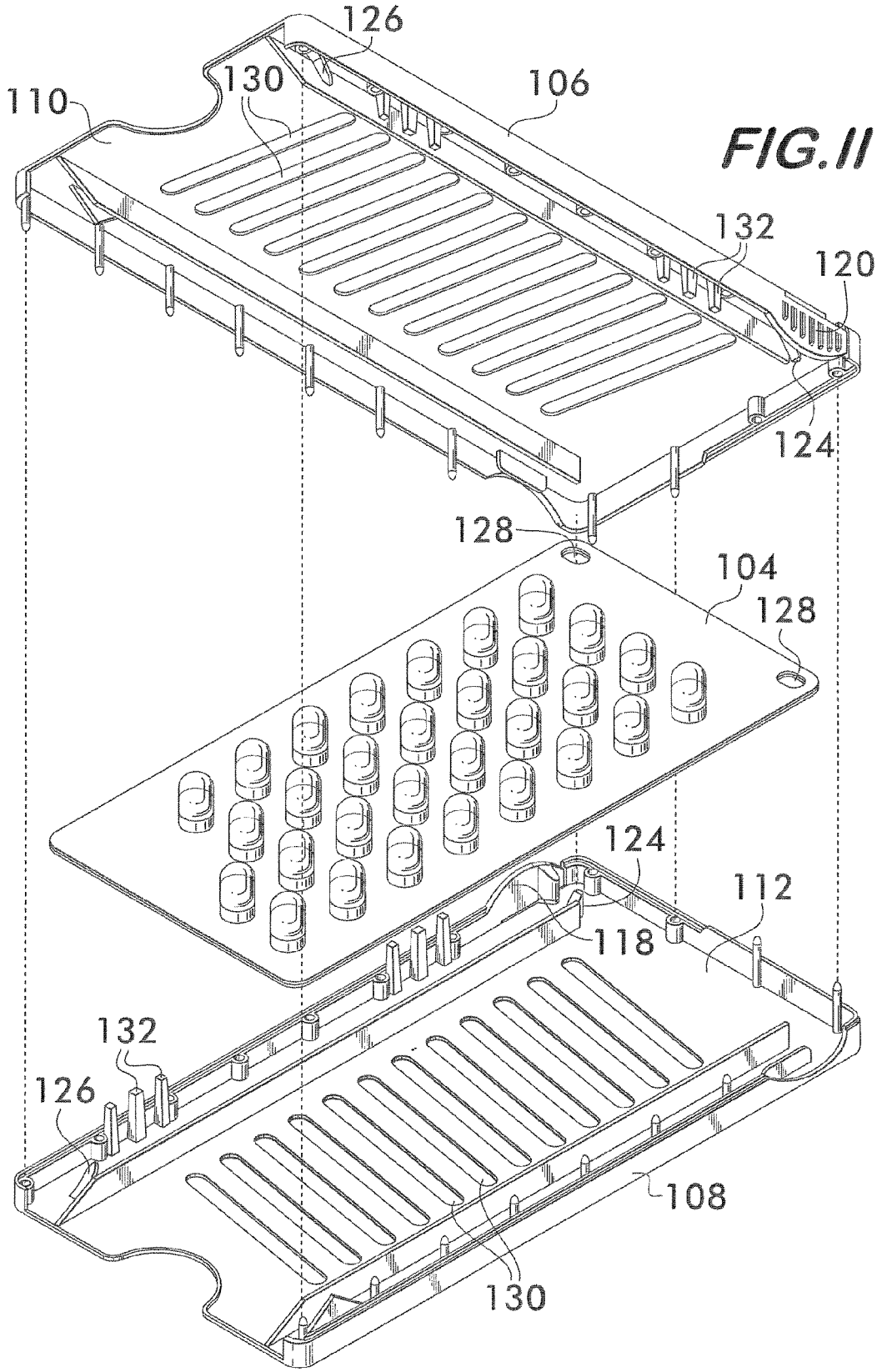
FIG. 11 is an exploded view of the package of FIG. 9 showing the respective alignment of the opposed body sections of the sleeve and the blister card therebetween.
Figure 12:
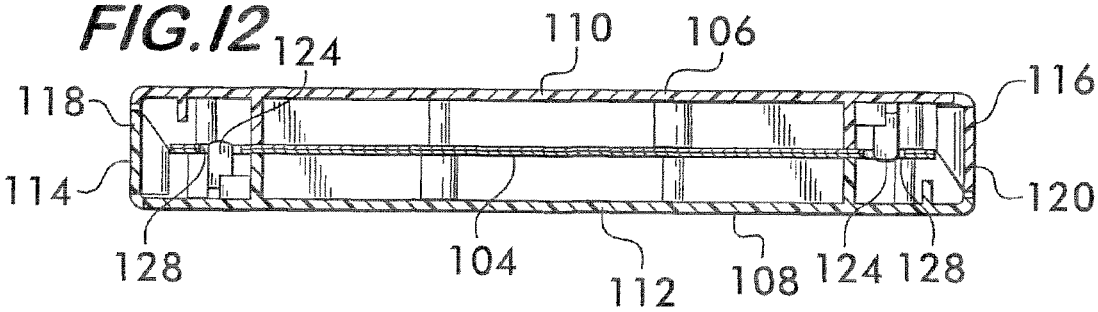
FIG. 12 is a cross-sectional view of the package of FIG. 9 along line 12-12 of FIG. 9 in which the blister card is in the storage position.
Figure 13:
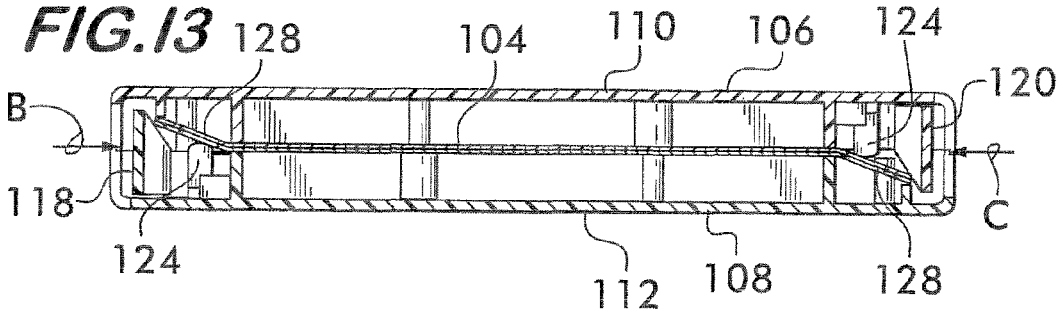
FIG. 13 is a cross-sectional view of the package of FIG. 9 similar to the cross-sectional view of FIG. 12 except that FIG. 13 shows the unlocking tabs on the opposite side edges of the sleeve in a depressed condition required to unlock the blister card from the sleeve.
Figure 14:
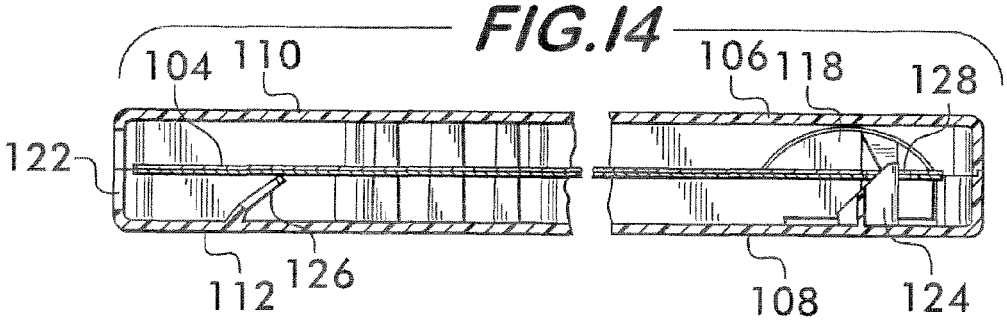
FIG. 14 is a cross-sectional view of the package of FIG. 9 along line 14-14 of FIG. 9 in which the blister card is in the storage position.
Figure 15:
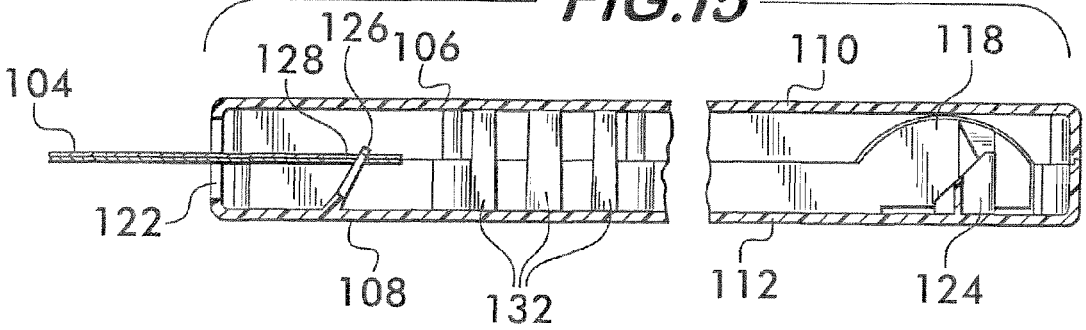
FIG. 15 is a cross-sectional view of the package of FIG. 9 similar to the cross-sectional view of FIG. 14 except that FIG. 15 shows the blister card in a dispensing position fully extended from the sleeve.
Figure 16:
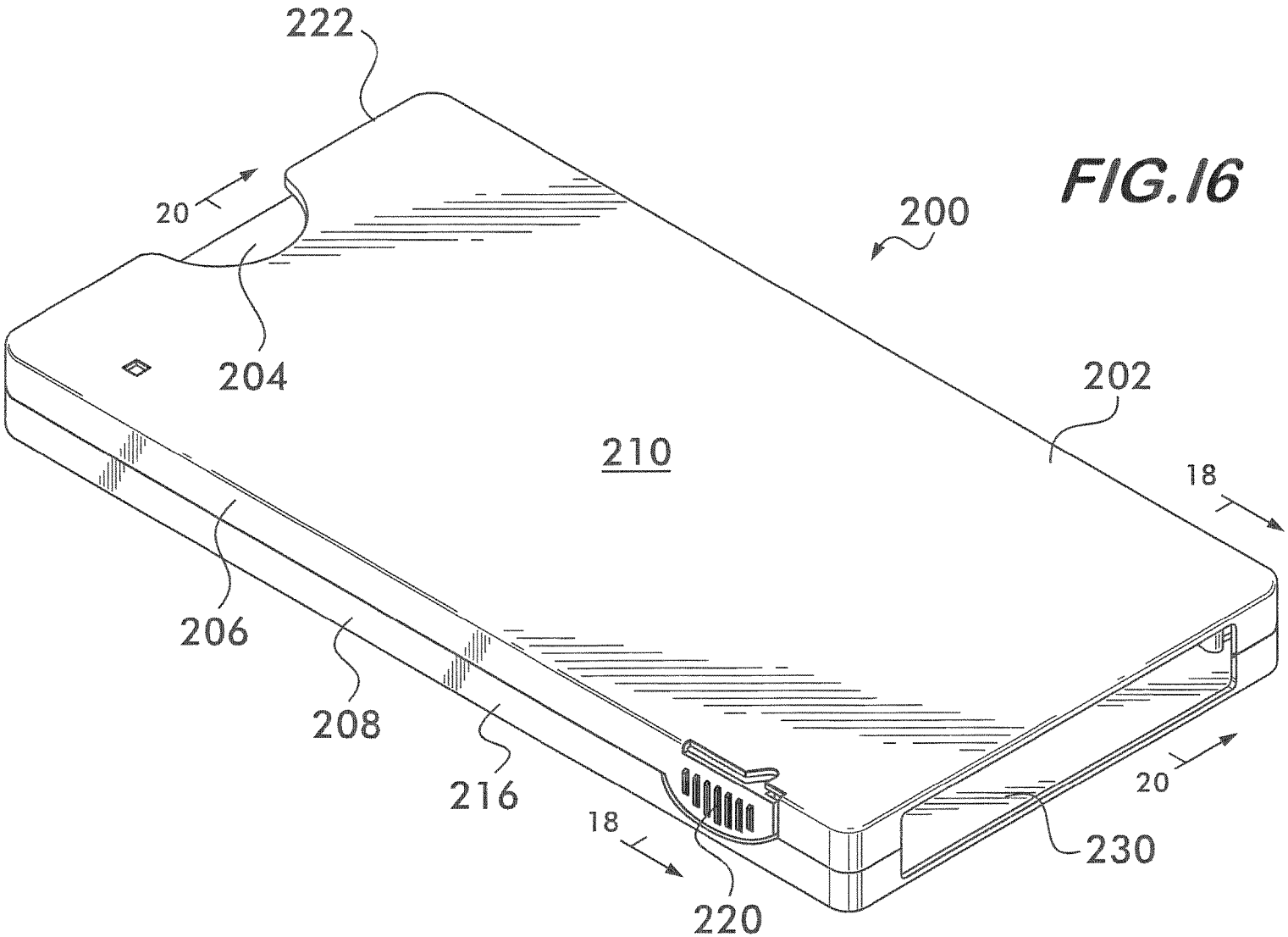
FIG. 16 is perspective view of a third embodiment of a package including a sleeve with a blister card retained in a storage position according to the present invention.
Figure 17:
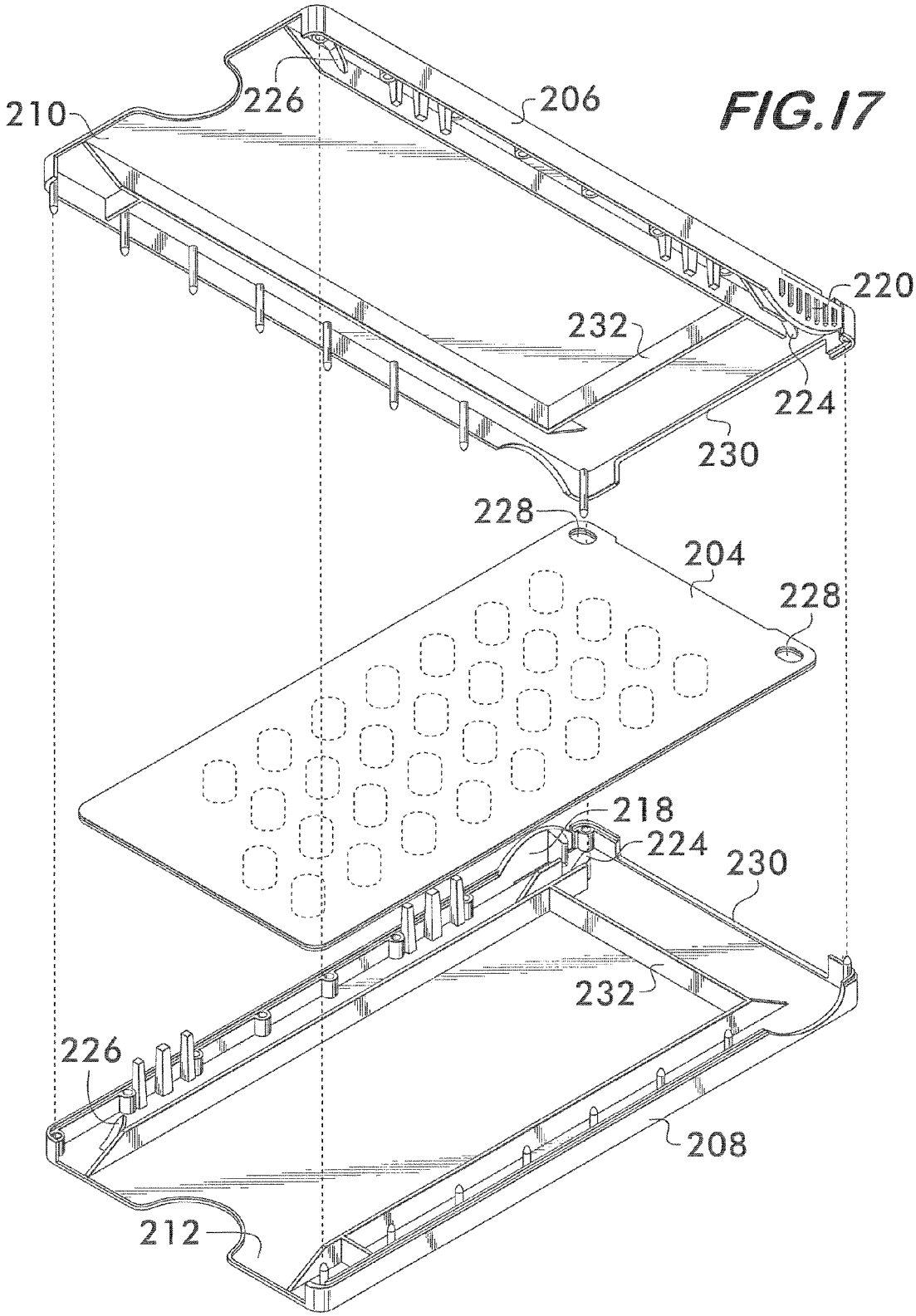
FIG. 17 is an exploded view of the package of FIG. 16 showing the respective alignment of the opposed body sections of the sleeve and the blister card therebetween.
Figure 18:
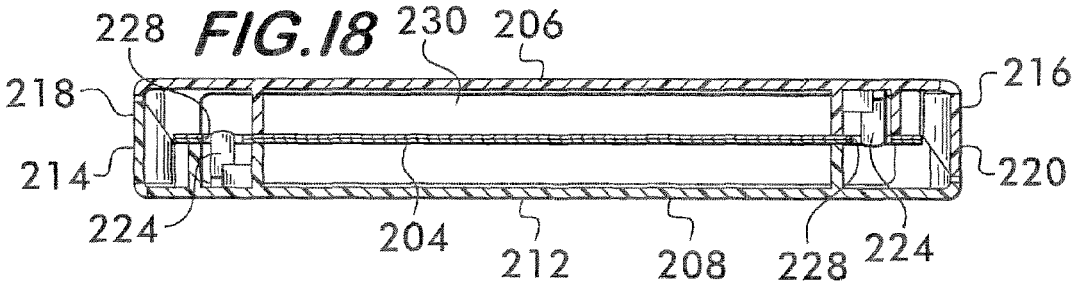
FIG. 18 is a cross-sectional view of the package of FIG. 16 along line 18-18 of FIG. 16 in which the blister card is in the storage position.
Figure 19:
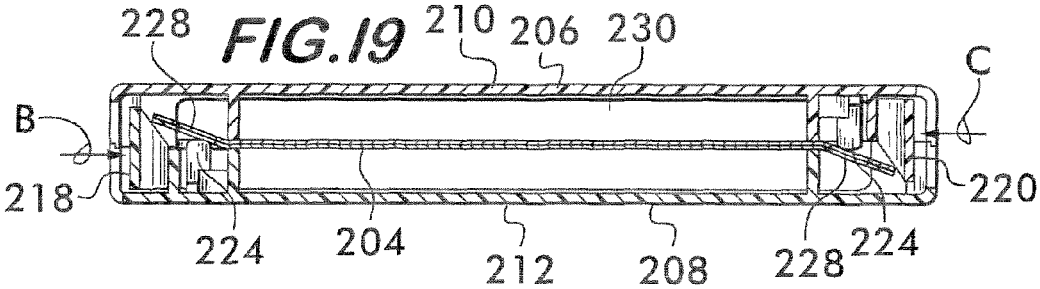
FIG. 19 is a cross-sectional view of the package of FIG. 16 similar to the cross-sectional view of FIG. 18 except that FIG. 19 shows the unlocking tabs on the opposite side edges of the sleeve in a depressed condition required to unlock the blister card from the sleeve.
Figure 20:
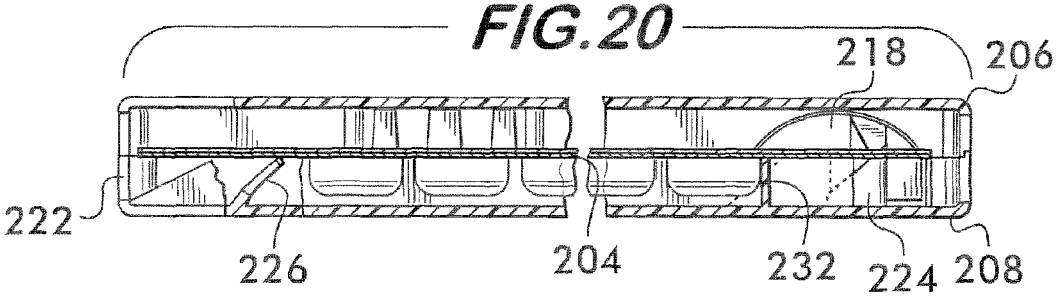
FIG. 20 is a cross-sectional view of the package of FIG. 16 along line 20-20 of FIG. 16 in which the blister card is in the storage position.
Figure 21:
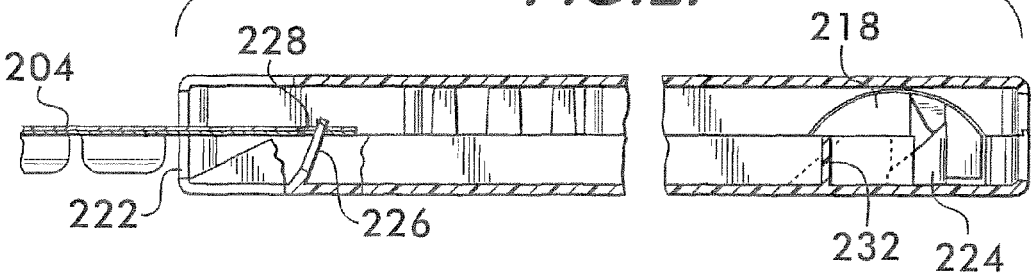
FIG. 21 is a cross-sectional view of the package of FIG. 16 similar to the cross-sectional view of FIG. 20 except that FIG. 21 shows the blister card in a dispensing position fully extended from the sleeve.
Figures 22, 23:
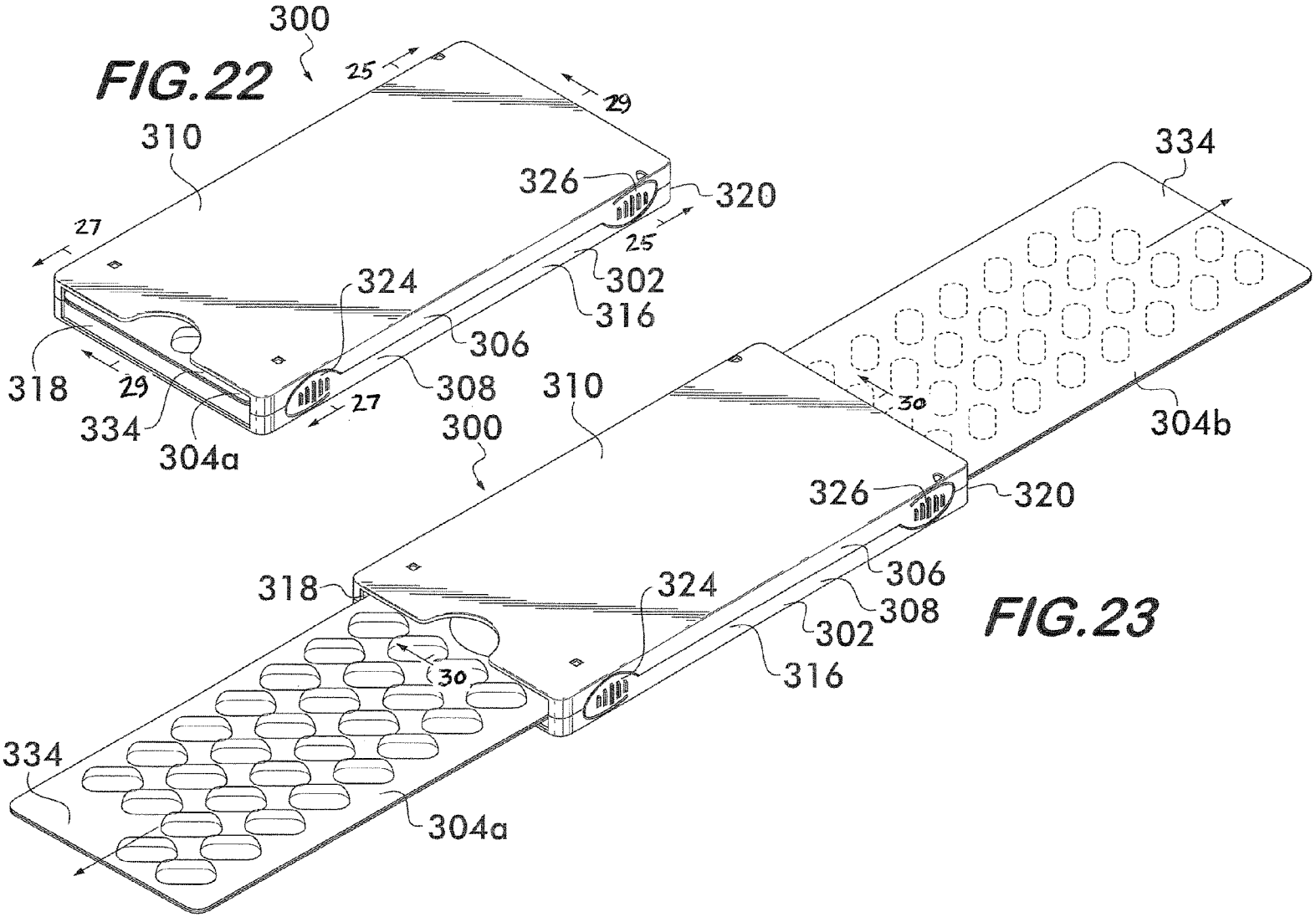
FIG. 22 is perspective view of a fourth embodiment of a package including a sleeve with a blister card retained in a storage position according to the present invention.
FIG. 23 is perspective view of the package of FIG. 22 in which both blister cards are shown in fully-extended dispensing positions.

A dispensing position of the card blister 12 relative to the sleeve 18 is best illustrated in FIG. 2 of the present application and enables access to at least some of the items carried by the blister card 12. If desired, the blister card 12 can be slid to a fully-extended dispensing position as best illustrated in FIG. 7. In the dispensing position, the blister card 12 partially extends through the dispensing end 28 of the sleeve 18 and is not fully separated from the sleeve 18. Rather, in the fully-extended dispensing position illustrated in FIG. 7, a distal end 30 of the blister card 12 remains captured within the sleeve 18 to tether the blister card 12 to the sleeve 18.

The blister card 12 is slid into the sleeve 18 to the storage position from the dispensing position by being pushed into the sleeve 18. The blister card 12 automatically becomes locked in the storage position and thereafter cannot be slid to the dispensing position until the above referenced multiple simultaneous actions are again performed. The above described operations permit the package 10 to have child-resistant properties sufficient for a so-called F=1 child resistant rating, yet still is able to be readily opened by an intended user during the entire life of the package 10. The package 10 can be adapted for use as a unit dose package.

Turning first to the structure of the blister card 12, it will typically have a thin sheet-like card section 32 with a plurality of blister compartments 34 projecting from a top face 36 of the card section 38. See FIG. 3. By way of example, the blister card 12 can be made of a transparent plastic tray defining a plurality of separate upstanding blister compartments 34 and have a foil backing 38 forming an underside 40 of the blister card 12 for sealing the pills, tablets or like items within the blister compartments 34. To dispense an item from the blister card 12, downward-directed finger pressure is applied to the blister compartment 34 to cause the stored item to break through the foil backing 38 and be released from the blister card 12.

In the illustrated embodiment, the card section 32 is generally rectangular in plan view having a predetermined length "L" and width "W". Of course, the card section 32 can be of other shapes in plan view. The blister compartments 34 project a predetermined height "H" from the upper face 36 of the card section 32. The card section 32 includes a front margin 42 adjacent a leading front edge 44 of the blister card 12, a rear margin 46 adjacent the distal end 30 of the blister card 12, and a pair of side margins, 48 and 50, extending lengthwise along the opposite sides of the blister card 12. No blister compartments 34 are located within any of the front, rear and side margins 42, 46, 48 and 50.

A further structural feature of the blister card 12 is the presence of a pair of latch catchers, or locking cavities, 52 and 54, with one being provided in each corner, 56 and 58, of the distal end 30 of the blister card 12. Each locking cavity, 52 and 54, extends within the rear margin 46 and one of the side margins, 48 and 50, of the card section 32 of the blister card 12. In the illustrated embodiment, the locking cavities 52 and 54 are shown as apertures; however, they can also be provided as slots, notches, depressions, receptacles, bent edges, upstanding formations, or like elements capable of providing an opening with a free edge for receiving and catching a latch. For example, an extra blister compartment can be formed on the distal end of the blister card and provide the necessary latch-catching structure, or a part of the blister card can be bent or otherwise formed to provide the latch-catching structure. Further, a separately-manufactured element can be added onto and secured to the distal end of the blister card to provide a latch-catcher.

As will be explained in greater detail, the latch-catching locking cavities, 52 and 54, can be used to serve a dual function of forming both a part of the mechanism used to lock the blister card 12 in the storage position (see FIGS. 4 and 6) within the sleeve 18 and a part of the mechanism used to prevent full separation of the blister card 12 from the sleeve 18 in the fully-extending dispensing position (see FIG. 7). Alternatively, the locking cavities, 52 and 54, can provide only one of the above referenced functions with a different structural element of the blister card providing the other function.

The compact sleeve 18 can be flat and generally rectangular, as best illustrated in FIG. 1, having upper and lower major wall panels, 20 and 22, preferably of dimensions that are only slightly greater than the length "L" and width "W" of the blister card 12. Of course, other wall shapes can also be used provided that the walls can function as a protective case for the blister card 12.

The dispensing end 28 of the sleeve 18 defines a slot-shaped dispensing opening through which the blister card 12 can be slid between retracted (storage) and extended (dispensing) positions relative to the sleeve 18. The sleeve 18 has an end 60 opposite the dispensing end 28 that can be closed, partially closed or open depending upon design and a pair of side edges, 24 and 26, which can define a height, or thickness, "T" of the slot-shaped opening of the dispensing end 28 of sleeve 18. For reasons to be stated, the height "T" of sidewalls 24 and 26 and/or dispending end 28 is preferably equal to approximately slightly more than twice the height "H" of the tallest blister compartment 34 of the blister card 12. The above referenced configuration enables the blister card 12 to be inserted face up or face down within the sleeve 12, and since the sleeve 18 is made from identical body sections 14 and 16, it is able to accommodate the blister card 12 in ether disposition. In addition, the blister compartments 34 of the blister card 12 are completely protected within the sleeve 18 when the blister card 12 is positioned and locked in the storage position. Thus, as best illustrated in FIG. 1, only a small portion of the leading front edge 44 of the blister card 12 is exposed and can be engaged and/or gripped by a user.

The slot-shaped opening of the dispensing end 28 of the sleeve 18 is sufficiently large only to permit the blister card 12 to slide in an end-to-end direction through the dispensing end 28 parallel to a longitudinal axis "A" of the card section 34 of the blister card 12 and the wall panels 20 and 22 of the sleeve 18. Thus, the dispensing end 28 provides a slot-like opening and only an end profile of the blister card 12 housed within the container body 18 is viewable when looking into an end of the sleeve 18. This absence of visual stimulation when the blister card 12 is in the storage position is desirable because it reduces stimulation to a young child to seek access to the contents despite the lack of a cap or like cover.

As discussed above, the blister card 12 is prevented from sliding relative to the sleeve 18 when in the locked storage position and thus cannot be accessed. Accordingly, gripping and pulling the exposed leading edge 44 of the blister card 12 by itself does not enable the blister card 12 to be passed through the dispensing end 28 of the sleeve 18. Rather, the blister card 12 must be pulled simultaneously while a pair of opposed tabs, 62 and 64, on sidewalls, 24 and 26, of the sleeve 18 are simultaneously pressed inward, such as between the thumb and finger of one hand of the user. This dual action unlocks the blister card 12 from the sleeve 18 and permits the blister card 12 to slide relative to the sleeve 18 through the dispensing end 28 of the sleeve 18 to a dispensing position.

As an added degree of child-resistance, the width "WS" of the sleeve 18 defines the amount of spacing between the opposed tabs, 62 and 64. Preferably, the width "W" is selected such that the spacing is sufficiently large to make it difficult for a young child having a small hand to be able to simultaneously depress both tabs, 62 and 64, with a single hand. For example, a width "WS" of 2 inches (5.1 cm) or greater can be selected for this purpose.

As discussed above, the sleeve 18 is preferably formed by a pair of body sections, 14 and 16. See FIG. 3. The body sections 14 and 16 are identical and therefore a single or the identical mold cavity, such as an injection mold cavity or the like, can be used to form both sections 14 and 16. This also simplifies assembly since all sections will be identical and any two sections from a large number of such sections can be mated or otherwise secured together to form the sleeve 18. Accordingly, it is not necessary to locate a specific top which must be mated to a specific bottom. All sections 14 and 16 are identical and any two can be used to form the sleeve 18, with there not necessarily being any pre-defined top or pre-defined bottom.

Figure 3:
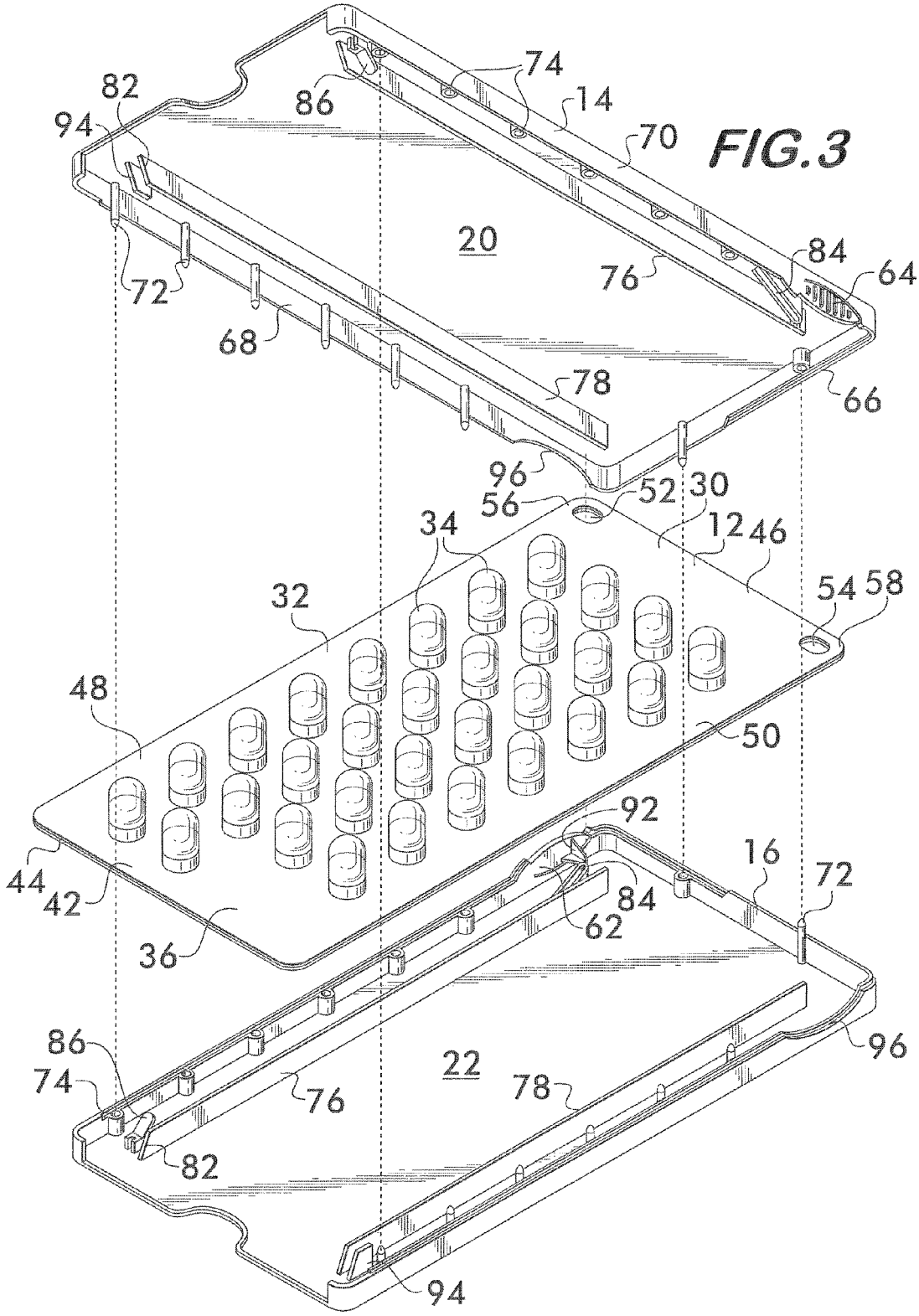
FIG. 3 is an exploded view of the package of FIG. 1 showing the respective alignment of the opposed body sections of the sleeve and the blister card therebetween.

FIG. 3 provides an illustration of a pair of identical one-piece integrally-molded plastic body sections 14 and 16. The body section 14 includes the major wall panel 20, an end wall section 66 which forms half of an end wall 60 of this particular embodiment of the sleeve 18, and opposite sidewall sections 68 and 70 which each form parts of the side edges 24 and 26 of the sleeve 18. The tab 62 is formed as part of the sidewall section 68 while a recess 96 is provided in sidewall 70 providing space for receiving the opposite tab 64 of the body section 16 when the body sections 14 and 16 are joined together. Preferably, a series of integral locking pins 72 and pin receptacles 74 are located along the perimeter of the body section 14 and are used to secure the body sections 14 and 16 together in a press or snap-fit manner (i.e., the pins 72 of one body section being received within the receptacles 74 of the opposite body section). Other means for securing the two body sections together can also be utilized.

The body section 14 includes a pair of longitudinally-extending ribs, rails, or spines, 76 and 78, that extend adjacent the opposite sidewall sections 68 and 70 of the body section 14. When body sections 14 and 16 are joined together to form the sleeve 18, a small gap 80 (best illustrated in FIGS. 4 and 5) is provided between each opposing set of support rails, 76 and 78. The gaps 80 are sufficient to receive the card section 32 of the blister card 12 therebetween and to permit the blister card 12 to slide relative to the sleeve 18 in a stable manner. Other movement of the card section 32 outside an imaginary plane extending through the gaps 80 is substantially prevented.

Figure 4:
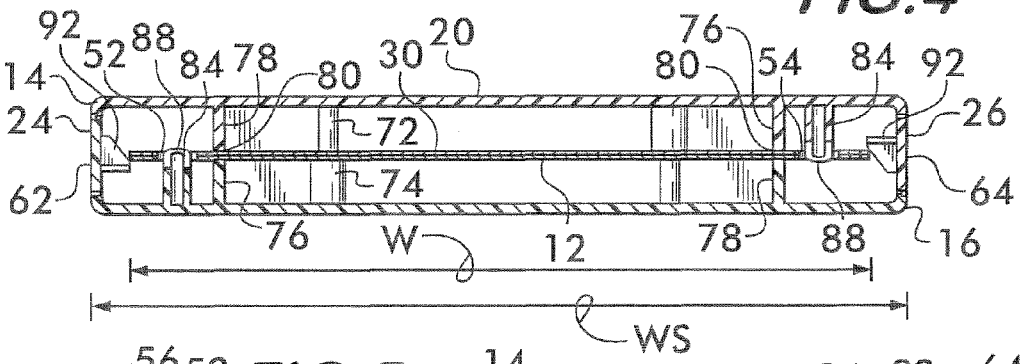
FIG. 4 is a cross-sectional view of the package of FIG. 1 along line 4-4 of FIG. 1 in which the blister card is in the storage position.
Figure 5:
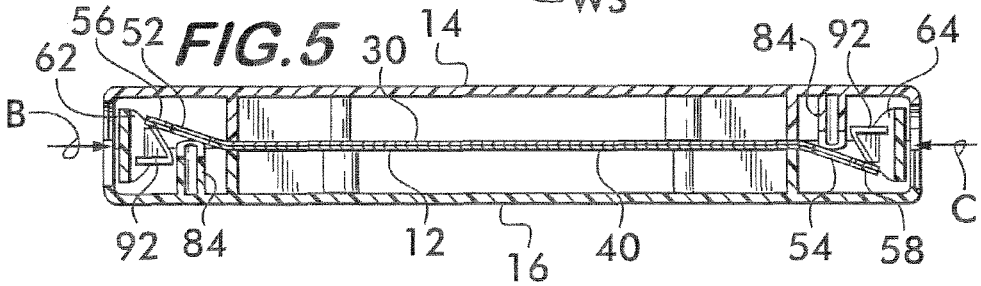
FIG. 5 is a cross-sectional view of the package of FIG. 1 similar to the cross-sectional view of FIG. 4 except that FIG. 5 shows the unlocking tabs on the opposite side edges of the sleeve in a depressed condition required to unlock the blister card from the sleeve.

The support rails, 76 and 78, support the card section 32 of the blister card 12 in a desired central disposition within the container body 18 substantially parallel to the major wall panels 20 and 22 of the sleeve 12 and substantially equally spaced from wall panels 20 and 22. This central disposition enables initial loading of the blister card 12 within the sleeve 18 to be face up or face down with no pre-defined orientation. The support rails, 76 and 78, also prevent unwanted movement of the blister card 12 within the container body 18 relative to the central disposition. Thus, the support rails 76 and 78 retain the card section 32 of the blister card 12 within the sleeve 18 and only permit sliding movement of the card section 32 within a single predetermined plane of movement relative to the sleeve 18. As best illustrated in FIGS. 4 and 5, the support rails 76 and 78 of body sections 14 and 16 are positioned such that they engage the side margins, 48 and 50, of the card section 32 and such that all blister compartments 34 are located between the two sets of support rails. The front edge 82 of each of the support rails 76 and 78 is tapered to enable easy receipt of the blister card 12 when initially loaded within and slid into the sleeve 18.

The latches, levers, posts, flanges, tabs, stops or like structures used to lock the blister card 12 in the storage position and to tether the blister card 12 to the sleeve 18 in the dispensing position are also provided as integral molded elements of the one-piece molded plastic body section 14. For example, as best shown in FIG. 8, a latch 84 extends adjacent the tab 62 between the sidewall section 68 and support rail 76, and as best illustrated in FIGS. 3, 6 and 7, a retaining tab 86 extends adjacent the dispensing end 28 between the sidewall section 68 and support rail 76.

Figure 6:
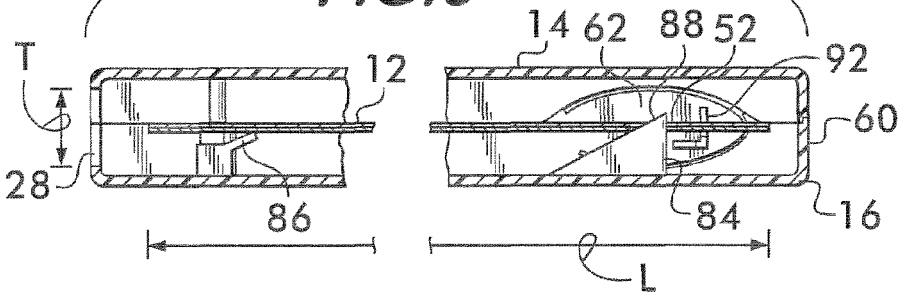
FIG. 6 is a cross-sectional view of the package of FIG. 1 along line 6-6 of FIG. 1 in which the blister card is in the storage position.

As shown in FIGS. 6 and 7, the latch 84 is provided as a tapered post, tab or flange extending from the major wall panel 20 and having an upper locking tip 88 which extends to a height greater than that of the adjacent support rail 76. When the blister card 12 is slid into the storage position, the front taper of the latch 84 directs the corner 56 of the card section 32 of the blister card 12 up over the locking tip 88 of the latch 84. However, eventually the locking cavity 52 of the blister card 12 registers with the latch 84 and the corner 56 of the card section 32 resiliently returns to its planar, non-deflected configuration. See FIG. 4. Accordingly, the locking cavity 52 receives and captures the locking tip 88 of the latch 84 thereby preventing the blister card 12 from being slid in a reverse dispensing direction relative to the sleeve 18.

For purposes of releasing the latch 84 from the locking cavity 52, the tab 62 is integrally molded with an inwardly-directed lifting aim 92 extending transversely within the sleeve 18 and transverse to the longitudinal axis "A". As best illustrated in FIG. 4, the lifting arm 92 is tapered providing a ramp and, when the tab 62 is pressed inward by a user (see arrows B and C in FIG. 5), the arm 92 engages underneath the card section 32 of the blister card 12 and flexes/lifts the corner 56 of the card section 32 above and over the locking tip 88 of the latch 84. See FIG. 5. In this condition, the blister card 12 is no longer prevented from sliding relative to the latches 84. After finger pressure is released from tabs 62 and 64, the tabs 62 and 64 resiliently return to their original position as shown in FIG. 4.

As shown in FIGS. 6 and 7, the retaining tab 86 is located near the dispensing end 28 of the sleeve 18 and can be in the form of a rearward-angled resilient flange or lever. When the blister card 12 is slid toward the storage position, the card section 32 of the blister card 12 presses against the retaining tab 86 thereby bending it downward and enabling the card 12 to slide over the tab 86. See FIG. 6. However, when the blister card 12 is slid to the fully-extended dispensing position, the locking cavity 52 or like other structure ultimately registers with the tab 86 which snaps up into the locking cavity 52. This also occurs with respect to the locking cavity 54 and the opposite retaining tab 86 extending in an opposite direction toward the blister card 12 from the opposite body section. Accordingly, the locking cavities 52 and 54 of the card section 32 become hooked onto the retaining tabs 86 to prevent the distal end 30 of the blister card 12 from releasing through the dispensing end 28 of the sleeve 18. An additional support wall 94 can be located opposite the tab 86 in the opposite body section of the sleeve 18 to stabilize this locking feature and prevent unwanted disconnection of the retaining tab 86 from the locking cavities 52 and 54.

The illustrated retaining tabs 86 provide only one example of a structure for tethering the card 12 to the sleeve 18. Other structures can be utilized. Also, in some embodiments, the card 12 may not need to be tethered to the sleeve 18 in the dispensing position.

As discussed above, preferably the body sections 14 and 16 are identical or are substantially identical (i.e., not merely a mirror image, but rather identical). Accordingly, as best illustrated in FIGS. 4 and 5, one of the latches 84 is provided adjacent each of the sidewalls 24 and 26 within the sleeve 18. However, one latch 84 extends downward from the upper wall panel 20 and one latch 84 extends upward from the lower wall panel 22. Thus, when both tabs 62 and 64 are pressed inward (see FIG. 5), the rear corner 56 of the blister card 12 is deflected in an upward direction to be released from latch 84 and the other rear corner 58 of the blister card 12 is deflected in an opposite or downward direction to be released from the oppositely-directed latch 84.

Similarly, with respect to the retaining tabs 86 adjacent the dispensing end 28 of the sleeve 18, one retaining tab 86 extends from the upper wall panel 20 and one retaining tab 86 extends from the lower wall panel 22. The opposite relationship of the latches 84 as well as the retaining tabs 86 within the sleeve 18 is due to the body sections 14 and 16 being identical.

An advantage of the package 10 of the present invention is that the body sections 14 and 16 can first be assembled together without the presence of the blister card 12. Thereafter, the blister card 12 can be slid into the dispensing end 28 of an assembled sleeve 18 and will automatically become locked within the sleeve 18 when inserted to the storage position. Thus, the blister card 12 does not interfere with or unnecessarily complicate the assembly of the sleeve 18. Also, since the body sections 14 and 16 are identical, there is no predefined top and bottom of the sleeve 18. For example, FIG. 3 illustrates an assembly in which the blister compartments 34 of the blister card 12 are received within body section 14 of the container body 12. However, as an alternative, the blister card 12 could have been initially loaded with the blister compartments 34 being housed within body section 16 (in this case, the blister compartments 34 would extend downward from the card section illustrated in FIG. 3). This further simplifies assembly and is the reason why the opening provided by the dispensing end 28 is of a height "T" that is approximately twice the height "H" of the blister compartments 34.

The above referenced package 10 is preferably produced utilizing automated, high-speed equipment enabling commercial-sized quantities of the packages 10 to be formed, assembled, and loaded with blister cards 12 in a cost efficient manner within a relatively short period of time. The packages 10 of the present invention meet and surpass the standards (F=1) required for a child proof package yet are easy to open and close by adults including senior citizens. Further, the packages 10 are made of materials that can be readily recycled thereby providing a package that is both environmentally-friendly and inexpensive to manufacture. Still further, the sleeves are capable of being made from recycled materials.

Various modifications are contemplated with respect to the packages of the present invention. For example, FIGS. 9-15 illustrate a second embodiment of a package 100 including a sleeve 102 and a single blister card 104. The blister card 104 is similar, if not identical, to the blister card 12 described above. Likewise, the sleeve 102 is similar to sleeve 18. For instance, the sleeve 102 is made from opposite identical body sections 106 and 108 and includes opposite major wall panels 110 and 112, opposite side edges 114 and 116 providing opposite unlocking tabs 118 and 120, and a single dispensing end 122. In addition, the sleeve 102 includes opposite directed latches 124 remote from the dispensing end 122 and oppositely directed stops or retaining tabs 126 adjacent the dispensing end 122. The latches 124 and retaining tabs 126 interact with latch-catchers 128 on the blister card 104, and the unlocking tabs 118 and 120 can be used to unlatch the latches 124 from the latch-catchers 128. For example, see FIGS. 12-15.

One difference between sleeve 102 and sleeve 18 is that the major wall panels 110 and 112 of sleeve 102 have a series of slot-shaped openings 130 formed therein. The openings 130 permit the sleeve 102 to be made of less plastic; however, the blister compartments of the blister card 104 are still safely housed and protected within the sleeve 102 when the blister card 104 is in the storage position. For instance, see FIG. 9.

Another difference is that the sleeve 102 includes additional structural supports 132 along the side edges 114 and 116 that reinforce the structure of the sleeve 102.

A third embodiment of a package 200 is illustrated in FIGS. 16-21. This embodiment includes a sleeve 202 and blister card 204. The blister card 204 is similar, if not identical, to blister card 12 described above. Likewise, the sleeve 202 is similar to sleeve 18. For instance, the sleeve 202 is made from opposite identical body sections 206 and 208 and includes opposite major wall panels 210 and 212, opposite side edges 214 and 216 providing opposite unlocking tabs 218 and 220, and a dispensing end 222. In addition, the sleeve 202 includes opposite directed latches 224 remote form the dispensing end 222 and oppositely directed stops or retaining tabs 226 adjacent the dispensing end 222. The latches 224 and retaining tabs 226 interact with latch-catchers 228 on the blister card 204, and the unlocking tabs 218 and 220 can be used to unlatch the latches 224 from the latch-catchers 128. For example, see FIGS. 18-21.

One difference between sleeve 202 and sleeve 18 is that the end 230 of the sleeve 202 is open. Thus, both the dispensing end 222 and the end opposite 230 the dispensing end 22 are open permitting visualization of the end profile of the blister card 204 within the sleeve 202. The use of opposite open ends 222 and 230 permits the sleeve 202 to be made of less plastic. This version of the sleeve 202 also includes a transversely extending stop 232 that extends transversely with respect to the longitudinal axis "A" of the package 200 adjacent the open end 230. The stop 232 directly engages the blister compartments of the blister card 204 and prevents the blister card 204 from being slid through end 230.

Figure 24:
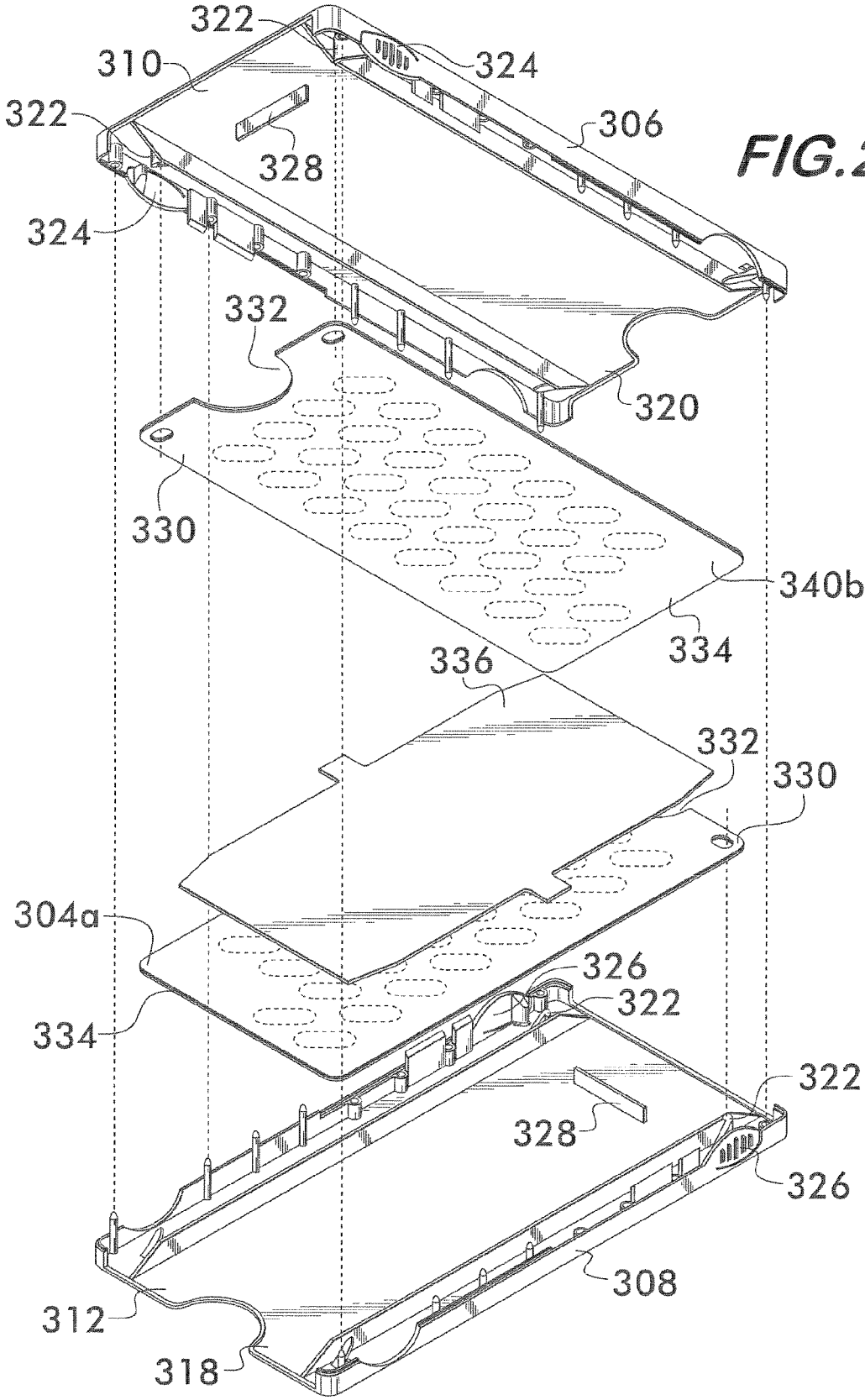
FIG. 24 is an exploded view of the package of FIG. 22 showing the respective alignment of the opposed body sections of the sleeve, a divider panel, and the pair of blister cards when both blister cards are in storage positions.
Figure 25:
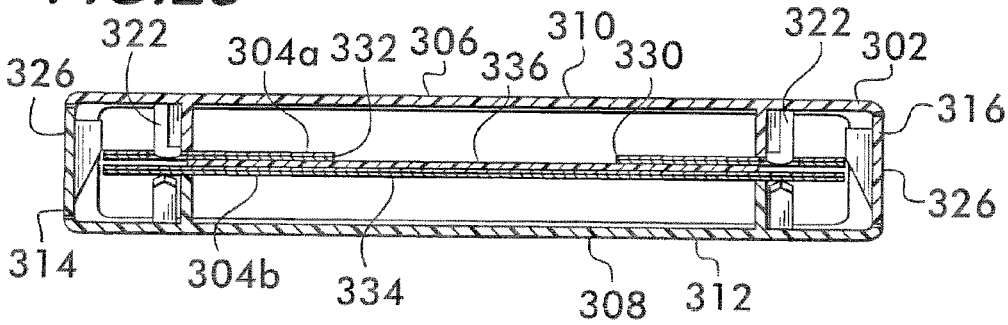
FIG. 25 is a cross-sectional view of the package of FIG. 22 along line 25-25 of FIG. 22 in which both blister cards are in the storage position.

A fourth embodiment of a package 300 is illustrated in FIGS. 22-30. This embodiment includes a sleeve 302, a divider panel 336, and two separate blister cards 304*a* and 304*b*. As best illustrated in FIG. 24, the divider panel 336 is sandwiched between the two blister cards 304*a* and 304*b*, and cards 304*a* and 304*b* are disposed in a back-to-back orientation such that the blister compartments of one card faces in one direction and the blister compartments of the other card faces in the opposite direction.

Each blister card 304*a* and 304*b* can be similar to blister card 12 described above. One difference is that each card 304*a* and 304*b* includes a distal end 330 having a cut-out section 332. The distal ends 330 of the cards 304*a* and 304*b* are located in opposite ends of the sleeve 302, and each cut-out section 332 overlies the leading front edge 334 of the adjacent card so that, when both cards overlap one another within the sleeve 302, the user can readily grip the leading edge 334 without obstruction from the distal end 330 of the other card.

The sleeve 302 is similar to sleeve 18 in some respects. For instance, the sleeve 302 is made from opposite identical body sections 306 and 308 and includes opposite major wall panels 310 and 312 and opposite side edges 314 and 316. However, unlike sleeve 18, the sleeve 302 has a pair of dispensing ends 318 and 320. One end 318 provides a dispensing end for the blister card 304*a*, and the other end 320 provides a dispensing end for the blister card 304*b*. Thus, the blister cards 304*a* and 304*b* are slid out opposite ends 318 and 320 of the sleeve 302 to dispensing positions. See FIG. 23.

Figure 26:
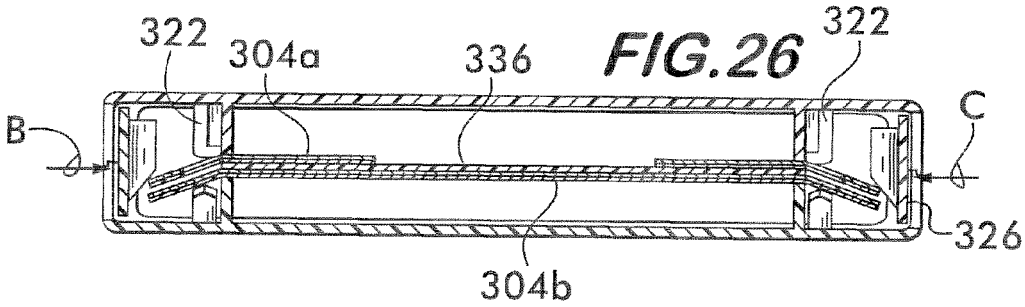
FIG. 26 is a cross-sectional view of the package of FIG. 22 similar to the cross-sectional view of FIG. 24 except that FIG. 25 shows the unlocking tabs on the opposite side edges of the sleeve in a depressed condition required to unlock the upper blister card as shown in the drawing from the sleeve.
Figure 27:
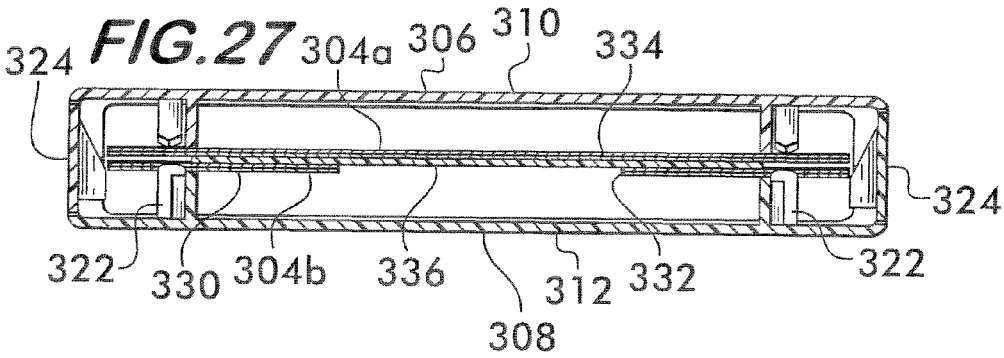
FIG. 27 is a cross-sectional view of the package of FIG. 22 along line 27-27 of FIG. 22 assuming both blister cards are in the storage position.
Figure 28:
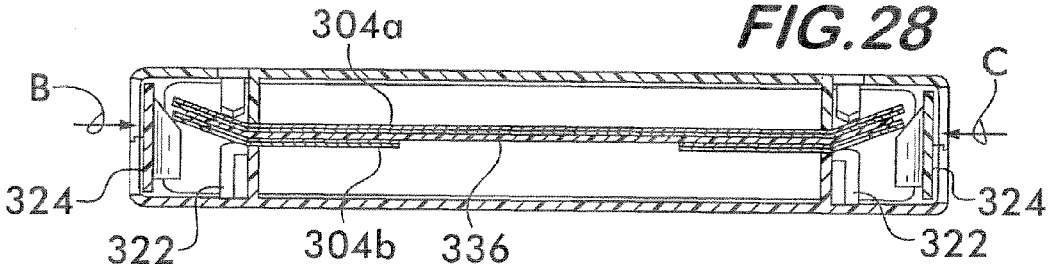
FIG. 28 is a cross-sectional view of the package of FIG. 22 similar to the cross-sectional view of FIG. 26 except that FIG. 27 shows the unlocking tabs on the opposite side edges of the sleeve in a depressed condition required to unlock the lower blister card as shown in the drawing from the sleeve.
Figure 29:
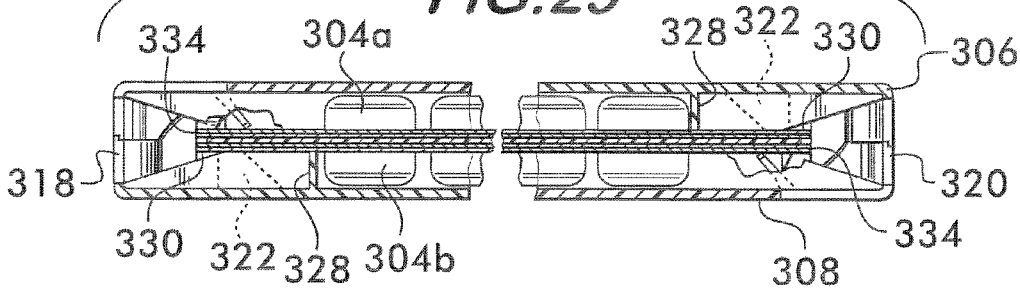
FIG. 29 is a cross-sectional view of the package of FIG. 22 along line 29-29 of FIG. 22 in which the blister cards are in the storage position.
Figure 30:
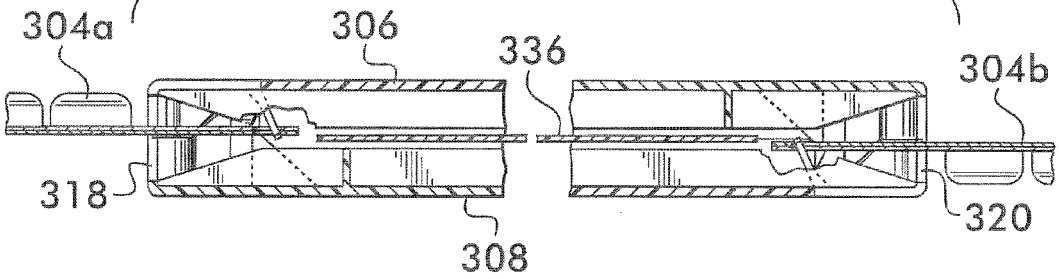
FIG. 30 is a cross-sectional view of the package of FIG. 23 along line 30-30 of FIG. 23 in which both blister cards are in a dispensing position fully extended from the sleeve.

Each body section 306 and 308 includes a pair of latches 222 at each end providing one set for each of the blister cards 304*a* and 304*b*, and the sleeve 302 provides a separate set of opposed unlocking tabs 224 and 226 in the side edges 314 and 316 of the sleeve 302. The separate sets of unlocking tabs 224 and 226 are located adjacent opposite ends of the side edges 314 and 316. For example, see FIG. 24. One set of the unlocking tabs is used to deflect the corners of the cards 304*a* and 304*b* in a downward direction as shown in FIG. 26; while, the opposite set of tabs is used to deflect the corners of the opposite ends of the cards 304*a* and 304*b* in an opposite direction as shown in FIG. 28.

Each body section 306 and 308 also includes a stop 328 that engages with the blister compartments of the adjacent card adjacent the distal end 330 of the card. In the configuration shown in FIG. 24, the stops 328 prevent passage of the blister card 304*a* out of the end 320 of the sleeve 302 and prevent passage of the blister card 304*b* out of the end 318 of the sleeve 302. Thus, each blister card can be slid through only one end of the sleeve and is prevented from sliding out the other end. However, because the identical body sections 306 and 308 are designed to be secured together when they are rotated to a position 180° relative to one another (see FIG. 24), the stops 328 are positioned at opposite ends of the sleeve 302. Accordingly, the cards are required to slide to dispensing positions through opposite ends of the sleeve 302.

While numerous packages have been described in detail, various modifications, alterations, and changes may be made without departing from the spirit and scope of the package according to the present invention as defined in the appended claims.

The invention claimed is:

1. A package having child-resistant, senior-friendly dispensing properties for storing and dispensing tablets or like items, comprising:

a blister card having a substantially flat card section and a plurality of blister compartments for holding the tablets or like items, said card section having a distal end, a proximal end and a face with said blister compartments projecting from said face; and a hollow plastic sleeve having an opposed pair of side edges and at least one dispensing end, said sleeve providing a protective housing for said blister card when said blister card is in a storage position within said sleeve in which said proximal end of said card section is adjacent said dispensing end of said sleeve, and said blister card being slidable in an end-to-end direction relative to said sleeve between said storage position and a dispensing position in which said proximal end of said card section extends outside said sleeve to expose said blister compartments;

said plastic sleeve being formed from separate first and second opposed molded body sections that are secured together;

a combination of said blister card and said sleeve providing a plurality of latches and latch-catchers that cooperate to automatically lock said blister card in said storage position when said blister card is slid within said sleeve to said storage position;

said opposed pair of side edges of said sleeve including a pair of opposed resiliently-depressible tabs for unlatching said latches from said latch-catchers when said pair of opposed tabs are simultaneously depressed toward one another;

said sleeve having opposite first and second major wall panels that extend substantially parallel to each other and to said card section of said blister card when said blister card is in said storage position within said sleeve, said opposed pair of side edges interconnecting said wall panels;

said first body section including said first major wall panel and one of said plurality of latches integrally molded with and extending from said first major wall panel adjacent a corner of said first major wall panel opposite said dispensing end of said sleeve;

said second body section including said second major wall panel and one of said plurality of latches integrally molded with and extending from said second major wall panel adjacent a corner of said second major wall panel opposite said dispensing end of said sleeve; and said blister card including a pair of said latch-catchers located adjacent opposite corners of said distal end of said card section of said blister card.

2. A package according to claim 1, wherein one of said pair of opposed resiliently-depressible tabs is formed integral with said first body section and the other of said pair of opposed resiliently-depressible tabs is formed integral with said second body section; and wherein both of said pair of resiliently-depressible tabs must be simultaneously depressed to permit said blister card to slide relative to said sleeve from said storage position to said dispensing position.

3. A package according to claim 2, wherein said side edges and said pair of opposed depressible tabs are spaced apart by at least 2 inches (5.1 cm), whereby said pair of opposed depressible tabs are difficult to simultaneously depress by a single small hand of a young child due to the spacing.

4. A package according to claim 2, wherein said first and second body sections of said sleeve are identical having been manufactured from a same mold or an identical copy of the same mold.

5. A package according to claim 1, wherein each of said latches is in the form of a post, tab or flange structure having a tapered side facing said dispensing end so that said blister card is easy to slide into said storage position, and wherein each of said latch catchers is in the form of an aperture, cavity, or notch formed in or by said blister card.

6. A package according to claim 5, wherein each of said tabs has an arm with a tapered surface extending transversely within said sleeve, wherein, when each of said tabs is depressed, each of said tapered surfaces of said arms engages and flexes one of said opposite corners of said distal end of said card section of the said blister card such that an adjacent one of said latches is released from an adjacent one of said latch-catchers.

7. A package according to claim 5, wherein said card section has front, rear and opposite side margins within which said blister compartments holding the tablets or like items do not extend, and wherein said latch-catchers are located on said rear margin and opposite ones of said side margins.

8. A package according to claim 7, wherein each of said first and second body sections have a spaced-apart pair of support rails extending from said wall panels, wherein said support rails of said first and second body sections within said sleeve extend adjacent said side edges of said sleeve and opposed ones of said support rails define a small gap therebetween in which said side margin of said card section of said blister card is received; and wherein said support rails support said side margins of said card section to stabilize a centralized position of said card section of said blister card within said sleeve and to stabilize sliding movement of said blister card relative to said sleeve.

9. A package according to claim 8, wherein one of said latches is adjacent to each opposed set of said support rails, and wherein each of said latches is of a greater height than an adjacent one of said support rails.

10. A package according to claim 1, wherein said first and second body sections have pins and receptacles enabling said first and second body sections to be secured together via a snap-fit engagement.

11. A package according to claim 1, wherein each of said first and second body sections of said sleeve include an integrally-formed blister card retaining stop, tab, post, or flange adjacent said dispensing end of said sleeve to prevent said distal end of said card section of said blister card from passing through said dispensing end of said sleeve when said blister card is slid to said dispensing position.

12. A package having child-resistant, senior-friendly dispensing properties for storing and dispensing tablets or like items, comprising:

a blister card having a substantially flat card section and a plurality of blister compartments for holding the tablets or like items; and a hollow plastic sleeve having an opposed pair of wall panels, an opposed pair of side edges and a dispensing end;

said sleeve providing a protective housing for said blister card when said blister card is in a storage position within said sleeve, and said blister card being slidable in an end-to-end direction relative to said sleeve between said storage position and a dispensing position in which said card section extends at least partially outside said sleeve to expose said blister compartments;

said sleeve including a pair of latches that extend in opposite directions from said opposed pair of wall panels toward said blister card;

said blister card including a pair of latch-catchers for cooperatively engaging and catching said oppositely-extending latches when said blister card is in said storage position to automatically lock said blister card in said storage position within said sleeve when said blister card is slid to said storage position;

said opposed pair of side edges of said sleeve including a pair of opposed resiliently-depressible tabs for unlatching said latches from said latch-catchers when said pair of opposed tabs are simultaneously depressed toward one another to permit said blister card to slide relative to said sleeve from said storage position to said dispensing position; and each of said tabs having an arm with a tapered surface extending transversely within said sleeve, wherein, when each of said tabs is depressed, each of said tapered surfaces of said arms engages and flexes said card section of the said blister card such that an adjacent one of said latches is released from an adjacent one of said latch-catchers, and wherein each of said arms flexes said card section in opposite directions since said latches extend in opposite directions toward said card.

13. A package according to claim 12, wherein said plastic sleeve is assembled from a pair of identical injection-molded body sections that are secured together whereby each of said body sections is integrally formed having one of said latches and one of said tabs.

14. A package according to claim 12, wherein said card section has front, rear and opposite side margins within which said blister compartments holding the tablets or like items do not extend, wherein said latch-catchers are located on said rear margin and opposite ones of said side margins; and wherein said latches extend adjacent opposite corners of said sleeve remote from said dispensing end.

15. A package according to claim 14, wherein said plastic sleeve is assembled from a pair of body sections, wherein said body sections have a spaced-apart pair of support rails extending from a wall panel thereof, wherein said support rails of said body sections within said sleeve extend adjacent said side edges of said sleeve and opposed ones of said support rails define a small gap therebetween in which said side margin of said card section of said blister card is received, and wherein said support rails support said side margins of said card section to stabilize a centralized position of said card section of said blister card within said sleeve and to stabilize sliding movement of said blister card relative to said sleeve.

16. A package according to claim 15, wherein each of said body sections of said sleeve includes an integrally-formed blister card retaining stop, tab, post, or flange adjacent said dispensing end of said sleeve to prevent said rear margin of said card section of said blister card from passing through said dispensing end of said sleeve when said blister card is slid to said dispensing position.

17. A package having child-resistant, senior-friendly dispensing properties for storing and dispensing tablets or like items, comprising:

at least two separate blister cards, each blister card having a substantially flat card section having a top and back face, and each blister card having a plurality of blister compartments that are for holding the tablets or like items and that project from said top face of said card section; and a hollow plastic sleeve having an opposed pair of wall panels, an opposed pair of side edges and an opposed pair of open dispensing ends;

said sleeve providing a protective housing for said blister cards when said blister cards are in storage positions within said sleeve, and each of said blister cards being separately slidable in an end-to-end direction relative to said sleeve between said storage position and a dispensing position in which said card section extends at least partially outside said sleeve to expose said blister compartments;

one of said blister cards being slidable relative to said sleeve to said dispensing position through one of said opposed pair of dispensing ends of said sleeve and the other one of said blister cards being slidable relative to said sleeve to said dispensing position through an opposite one of said opposed pair of dispensing ends of said sleeve;

said sleeve including a separate set of latches for each of said blister cards, and each of said blister cards including a pair of latch-catchers for cooperatively engaging and catching one of said separate sets of latches when said blister card is in said storage position to automatically lock said blister card in said storage position within said sleeve when said blister card is slid to said storage position;

said opposed pair of side edges of said sleeve including separate sets of opposed resiliently-depressible tabs, wherein one set of tabs is for unlatching said latches from said latch-catchers of one of said blister cards and the other set of tabs is for unlatching said latches from said latch-catchers of the other one of said blister cards; and each of said tabs having an arm with a tapered surface extending transversely within said sleeve, and wherein, when each of said tabs is depressed, each of said tapered surfaces of said arms engages and flexes said card section of the said blister card such that an adjacent one of said latches is released from an adjacent one of said latch-catchers.

18. A package according to claim 17, further comprising a divider positioned between said blister cards within said sleeve, and wherein said blister cards are disposed back-to-back within said sleeve with said divider sandwiched therebetween.

19. A package according to claim 17, wherein said plastic sleeve is assembled from a pair of identical injection-molded body sections that are secured together.

20. A package according to claim 17, wherein said plastic sleeve is assembled from a pair of body sections, wherein each of said body sections has a spaced-apart pair of support rails extending from a wall panel thereof, wherein said support rails of said body sections within said sleeve extend adjacent said side edges of said sleeve and opposed ones of said support rails define a small gap therebetween in which side margins of said blister cards are received, and wherein said support rails support said side margins of said card sections to stabilize a centralized position of said card sections of said blister cards within said sleeve and to stabilize sliding movement of said blister cards relative to said sleeve.

21. A package according to claim 17, wherein said plastic sleeve is assembled from a pair of body sections, wherein each of said body sections of said sleeve includes an integrally-formed blister card retaining stop, tab, post, or flange adjacent each one of said open dispensing ends of said sleeve to prevent a rear margin of said card section of said blister cards from passing through either of said dispensing ends of said sleeve.

22. A package having child-resistant, senior-friendly dispensing properties for storing and dispensing tablets or like items, comprising:

a blister card having a substantially flat card section and a plurality of blister compartments for holding the tablets or like items; and a hollow plastic sleeve having an opposed pair of wall panels, an opposed pair of side edges and a dispensing end;

said sleeve providing a protective housing for said blister card when said blister card is in a storage position within said sleeve, and said blister card being slidable in an end-to-end direction relative to said sleeve between said storage position and a dispensing position in which said card section extends at least partially outside said sleeve to expose said blister compartments;

said sleeve including a pair of latches that extend from at least one of said wall panels toward said blister card;

said blister card including a pair of latch-catchers for cooperatively engaging and catching said oppositely-extending latches when said blister card is in said storage position to automatically lock said blister card in said storage position within said sleeve when said blister card is slid to said storage position;

said opposed pair of side edges of said sleeve including a pair of opposed resiliently-depressible tabs for unlatching said latches from said latch-catchers when said pair of opposed tabs are simultaneously depressed toward one another to permit said blister card to slide relative to said sleeve from said storage position to said dispensing position; and each of said tabs having an arm with a tapered surface extending transversely within said sleeve, wherein, when each of said tabs is depressed, each of said tapered surfaces of said arms engages and flexes said card section of the said blister card such that an adjacent one of said latches is released from an adjacent one of said latch-catchers.

* * * * *